US011499202B2

(12) United States Patent
Seki et al.

(10) Patent No.: US 11,499,202 B2
(45) Date of Patent: Nov. 15, 2022

(54) COOLING METHOD FOR WORKPIECE

(71) Applicant: AISIN FUKUI CORPORATION, Echizen (JP)

(72) Inventors: Akihiro Seki, Echizen (JP); Nobuyuki Naito, Echizen (JP); Yoichi Jinza, Echizen (JP); Hiroshi Fukuchi, Tokyo (JP); Kazuo Hikida, Tokyo (JP); Ken Takata, Tokyo (JP); Naruhiko Nomura, Tokyo (JP)

(73) Assignee: AISIN FUKUI CORPORATION, Echizen (JP)

( * ) Notice: Subject to any disclaimer, the term of this patent is extended or adjusted under 35 U.S.C. 154(b) by 0 days.

(21) Appl. No.: 17/225,287

(22) Filed: Apr. 8, 2021

(65) Prior Publication Data

US 2021/0222264 A1 Jul. 22, 2021

Related U.S. Application Data

(62) Division of application No. 16/095,109, filed as application No. PCT/JP2017/015536 on Apr. 18, 2017, now Pat. No. 11,104,971.

(30) Foreign Application Priority Data

Apr. 25, 2016 (JP) ..... 2016-086983

(51) Int. Cl.
*C21D 1/673* (2006.01)
*B21D 37/16* (2006.01)
(Continued)

(52) U.S. Cl.
CPC ..... *C21D 1/673* (2013.01); *B21D 22/022* (2013.01); *B21D 22/20* (2013.01); *B21D 24/00* (2013.01);
(Continued)

(58) Field of Classification Search
CPC ..... B21D 22/022; B21D 22/20; B21D 24/00; B21D 37/16; C21D 1/18; C21D 1/673; C21D 9/00
(Continued)

(56) References Cited

U.S. PATENT DOCUMENTS 6,312,628 B1 11/2001 Wieder et al.
8,069,697 B2 12/2011 Kurisu et al.
(Continued)

FOREIGN PATENT DOCUMENTS

CH 673603 A5 3/1990
JP 44-158 B1 1/1969
(Continued)

OTHER PUBLICATIONS

International Search Report (PCT/ISA/210) with translation and Written Opinion (PCT/ISA/237) dated Jul. 11, 2017, by the Japan Patent Office as the International Searching Authority for International Application No. PCT/JP2017/015536.
(Continued)

*Primary Examiner* — Jessee R Roe
*Assistant Examiner* — Michael Aboagye
(74) *Attorney, Agent, or Firm* — Buchanan Ingersoll & Rooney PC

(57) ABSTRACT

A cooling method for a workpiece includes placing entirety of the workpiece in an inner space of a recess provided on a molding surface of a lower mold, pressing or restraining the workpiece by a mold including the lower mold and an upper mold in which a protrusion corresponding to the recess of the lower mold is provided on a molding surface, supplying a liquid coolant to the inner space of the recess through a coolant supply passage provided in at least one of the lower mold and the upper mold by a pump, and discharging air in the inner space of the recess upward through
(Continued)

an air escape passage, and cooling the workpiece by immersing the entirety of the workpiece, which has been heated, in the liquid coolant that fills the recess.

12 Claims, 9 Drawing Sheets

(51) Int. Cl.

| | |
|---|---|
| ***C21D 1/18*** | (2006.01) |
| ***C21D 9/00*** | (2006.01) |
| ***B21D 24/00*** | (2006.01) |
| ***B21D 22/20*** | (2006.01) |
| ***B21D 22/02*** | (2006.01) |

(52) U.S. Cl.
CPC ..... *B21D 37/16* (2013.01); *C21D 1/18* (2013.01); *C21D 9/00* (2013.01)

(58) Field of Classification Search
USPC ..... 266/46, 149, 259, 260; 148/559; 72/342.2, 342.3, 342.5, 342.7, 348, 469, 72/457, 459, 460
See application file for complete search history.

(56) References Cited

U.S. PATENT DOCUMENTS

| | | | | |
|---|---|---|---|---|
| 8,268,226 | B2 * | 9/2012 | Vander Wel | B29C 43/36 264/296 |
| 8,307,687 | B2 | 11/2012 | Kurisu et al. | |
| 8,327,680 | B2 * | 12/2012 | Kurisu | B21D 22/208 72/342.2 |
| 8,555,691 | B2 | 10/2013 | Yamasaki et al. | |
| 9,227,238 | B2 * | 1/2016 | Ishii | B21D 22/286 |
| 11,104,971 | B2 * | 8/2021 | Seki | C21D 9/00 |
| 2008/0196800 | A1 * | 8/2008 | Beenken | B21D 22/022 72/342.94 |
| 2010/0187291 | A1 | 7/2010 | Kriegner et al. | |
| 2011/0262765 | A1 | 10/2011 | Yu et al. | |
| 2019/0100816 | A1 | 4/2019 | Seki et al. | |

FOREIGN PATENT DOCUMENTS

| | | | |
|---|---|---|---|
| JP | 5635725 | A | 4/1981 |
| JP | H07051795 | A | 2/1995 |
| JP | H07096553 | A | 4/1995 |
| JP | 2005169394 | A | 6/2005 |
| JP | 2006198666 | A | 8/2006 |
| JP | 2007075835 | A | 3/2007 |
| JP | 2008036709 | A | 2/2008 |
| JP | 2010519048 | A | 6/2010 |
| JP | 2011230188 | A | 11/2011 |
| JP | 2012122091 | A | 6/2012 |
| KR | 20050048282 | A | 5/2005 |

OTHER PUBLICATIONS

Office Action dated Feb. 5, 2021, by the German Patent Office in corresponding German Patent Application No. 11 2017 001 285.6 and an English Translation of the Office Action. (17 pages).
Office Action (Notice of Final Rejection) dated May 19, 2020 by the Korean Intellectual Property Office in corresponding Korean Patent Application No. 10-2018-7033424 and an English Translation of the Office Action. (6 pages).
Office Action (Notification of Reason for Refusal) dated Nov. 14, 2019 by the Korean Intellectual Property Office in corresponding Korean Patent Application No. 10-2018-7033424 and an English Translation of the Office Action. (14 pages).
Office Action (The First Office Action) dated Sep. 26, 2019 by the State Intellectual Property Office of People's Republic of China in corresponding Chinese Patent Application No. 201780025567.6 and an English Translation of the Office Action. (10 pages).
Office Action (The Second Office Action) dated Apr. 9, 2020 by the State Intellectual Property Office of People's Republic of China in corresponding Chinese Patent Application No. 201780025567.6 and an English Translation of the Office Action. (16 pages).

* cited by examiner

COOLING METHOD FOR WORKPIECE

CROSS-REFERENCES TO RELATED APPLICATIONS

This application is a Divisional of U.S. application Ser. No. 16/095,109 filed Oct. 19, 2018, now U.S. Pat. No. 11,104,971 issued Aug. 31, 2021, which is the National Stage of PCT/JP2017/015536 filed Apr. 18, 2017, and claims the benefit of JP2016-086983 filed Apr. 25, 2016, the entire content of each of which is incorporated by reference herein.

TECHNICAL FIELD

The present invention relates to a mold that quenches a heated workpiece while pressing or restraining the same, a mold apparatus including the mold, and a cooling method for a workpiece using the mold.

BACKGROUND ART

In general, a mold that quenches a heated workpiece while pressing the same is known. Such a mold is disclosed in Japanese Patent Laid-Open No. 2005-169394, for example.

Japanese Patent Laid-Open No. 2005-169394 discloses a hot press apparatus that press-molds a heated metal plate material. In this hot press apparatus, an ejection hole through which a cooling medium such as water is ejected to a molding surface of a mold is provided in one of an upper mold and a lower mold, and a heated molded article that has been pressed is forcibly cooled in a pressed state with the cooling medium ejected through the ejection hole.

PRIOR ART

Patent Document

Patent Document 1: Japanese Patent Laid-Open No. 2005-169394

SUMMARY OF THE INVENTION

Problem to be Solved by the Invention

However, in the hot press apparatus disclosed in Japanese Patent Laid-Open No. 2005-169394, when the cooling medium is stored in a space in which the pressed molded article is placed, air is not discharged from the space in which the molded article is placed but remains therein such that the air may conceivably continue to contact the molded article. In this case, the cooling medium does not sufficiently cool a portion that the air contacts, and thus it becomes difficult to uniformly cool the molded article. When the heated molded article (workpiece) is not uniformly cooled, hardness difference or the like occurs in the molded article (workpiece).

The present invention has been proposed in order to solve the aforementioned problem, and an object of the present invention is to provide a mold capable of uniformly cooling a workpiece when cooling the heated workpiece while pressing or restraining the same, a mold apparatus including the mold, and a cooling method for a workpiece using the mold.

Means for Solving the Problem

In order to attain the aforementioned object, a mold according to a first aspect of the present invention cools a heated workpiece while pressing or restraining the workpiece, and includes a lower mold in which a recess that stores a liquid coolant that cools the workpiece is provided on a molding surface and entirety of the workpiece is placed in an inner space of the recess and an upper mold in which a protrusion corresponding to the recess of the lower mold is provided on a molding surface. At least one of the lower mold and the upper mold includes a coolant supply passage through which the liquid coolant is supplied to the inner space of the recess, and the mold includes an air escape passage through which air in the inner space of the recess is discharged upward. In the present invention, the "molding surfaces" are surfaces that face each other in the upper mold and the lower mold, and are surfaces pressed or restrained in contact with the workpiece.

In the mold according to the first aspect of the present invention, as described above, the entirety of the workpiece is placed in the inner space of the recess of the lower mold, and the coolant supply passage through which the liquid coolant is supplied to the inner space of the recess is provided in at least one of the lower mold and the upper mold. Thus, the entirety of the workpiece can be reliably immersed in the liquid coolant, and contact of the air with the workpiece can be significantly reduced or prevented. Furthermore, the air escape passage through which the air in the inner space of the recess is discharged upward is provided in the mold such that the recess including the inner space in which the entirety of the workpiece in a pressed or restrained state is placed is filled with the liquid coolant, and thus the air in the inner space of the recess can be discharged upward through the air escape passage. Thus, supply of the liquid coolant to a surface of the workpiece is not hindered unlike the case where the air remains in the inner space of the recess. Consequently, the workpiece can be uniformly cooled when the heated workpiece is cooled in the pressed or restrained state.

A mold apparatus according to a second aspect of the present invention includes the mold according to the first aspect, a pump that supplies the liquid coolant to the coolant supply passage of the mold, and a controller that controls the pump to supply the liquid coolant.

The mold apparatus according to the second aspect of the present invention includes the mold according to the first aspect such that similarly to the first aspect, the workpiece can be uniformly cooled when the heated workpiece is cooled in a pressed or restrained state. Furthermore, liquid coolant supply is controlled by the controller such that liquid coolant flow in the recess can be adjusted while the air in the inner space of the recess is discharged upward through the air escape passage. Thus, the workpiece can be reliably cooled with the liquid coolant.

A cooling method for a workpiece according to a third aspect of the present invention includes placing entirety of the workpiece in an inner space of a recess provided on a molding surface of a lower mold, pressing or restraining the workpiece by a mold including the lower mold and an upper mold in which a protrusion corresponding to the recess of the lower mold is provided on a molding surface, supplying a liquid coolant to the inner space of the recess through a coolant supply passage provided in at least one of the lower mold and the upper mold by a pump and discharging air in the inner space of the recess upward through an air escape passage, and cooling the workpiece by immersing the entirety of the workpiece, which has been heated, in the liquid coolant that fills the recess. It should be noted that the order of a step of "placing the entirety of the workpiece in the inner space of the recess provided on the molding surface of the lower mold", a step of "pressing or restraining the workpiece by the mold including the lower mold and the upper mold in which the protrusion corresponding to the recess of the lower mold is provided on the molding surface", and a step of "supplying the liquid coolant to the inner space of the recess through the coolant supply passage provided in at least one of the lower mold and the upper mold by the pump and discharging the air in the inner space of the recess upward through the air escape passage" is not particularly limited to the above-described order. Furthermore, in the step of "pressing or restraining the workpiece by the mold", the mold may not press or restrain a portion that does not need to be deformed or a portion that does not need to be restrained. That is, it is not necessary for the mold to press or restrain the entirety of the workpiece, and the mold may press or restrain only a portion of the workpiece.

In the cooling method for the workpiece according to the third aspect of the present invention, the liquid coolant is supplied to the inner space of the recess through the coolant supply passage provided in at least one of the lower mold and the upper mold by the pump, the air in the inner space of the recess is discharged upward through the air escape passage, and the workpiece is cooled by immersing the entirety of the heated workpiece in the liquid coolant that fills the recess. Thus, similarly to the first aspect, the workpiece can be uniformly cooled when the heated workpiece is cooled in a pressed or restrained state. Furthermore, the liquid coolant is supplied to the inner space of the recess by the pump such that the air in the inner space can be discharged, and the flow rate of the liquid coolant can be controlled. Thus, the workpiece can be more effectively cooled.

Effect of the Invention

According to the present invention, as described above, the mold capable of uniformly cooling the workpiece when cooling the heated workpiece while pressing or restraining the same, the mold apparatus including the mold, and the cooling method for the workpiece using the mold can be provided.

MODES FOR CARRYING OUT THE INVENTION

Embodiments of the present invention are hereinafter described.

First Embodiment

The structure of a mold apparatus 100 according to a first embodiment of the present invention is now described with reference to FIGS. 1 to 10.

(Structure of Mold Apparatus)

Figure 1:
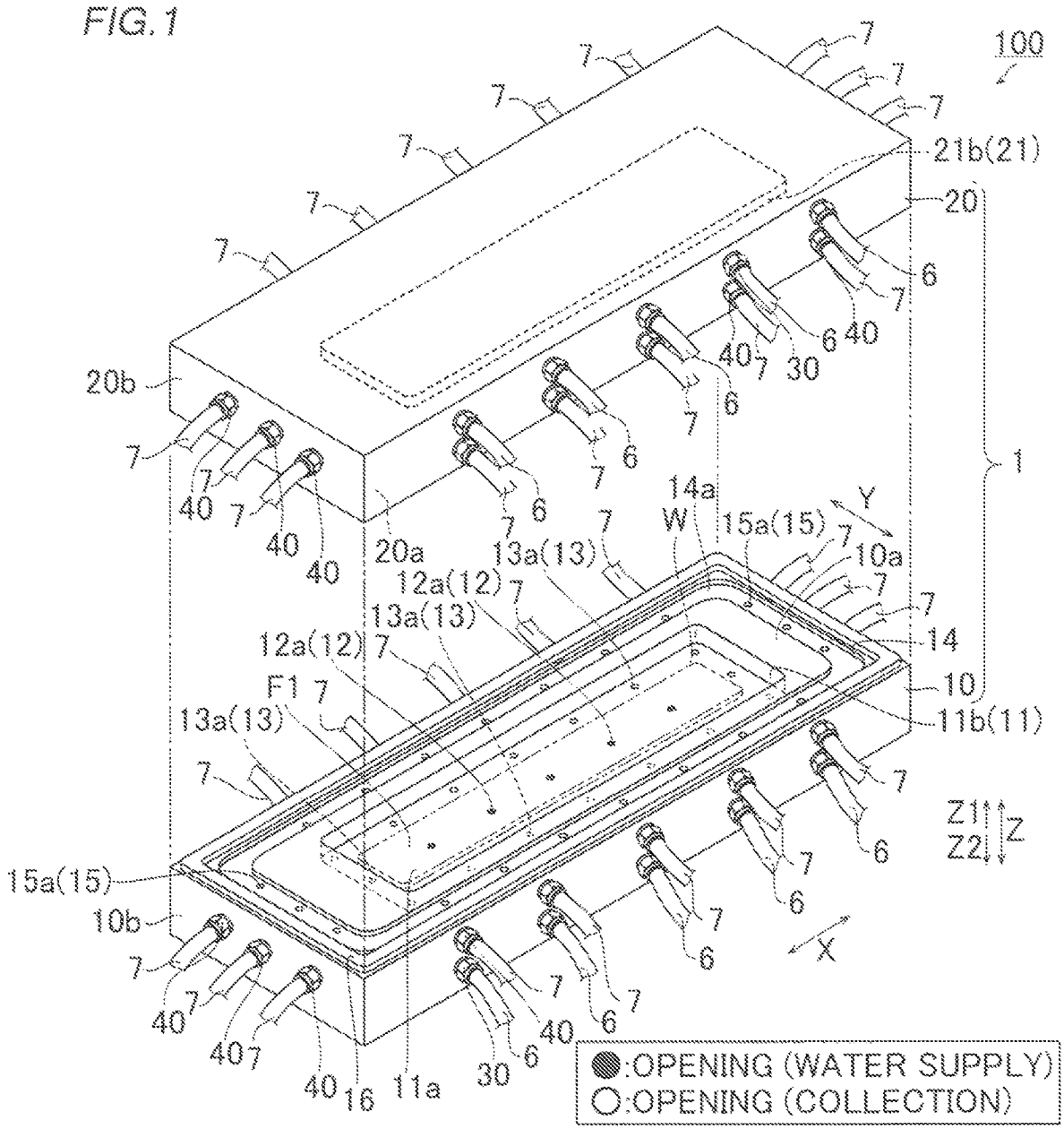
[FIG. 1] A perspective view of a mold apparatus (mold) according to a first embodiment of the present invention.

As shown in FIG. 1, the mold apparatus 100 according to the first embodiment is a so-called press quench apparatus that rapidly cools and quenches a heated workpiece W by bringing water into direct contact with the workpiece W while sandwiching the workpiece W. The water is an example of a "liquid coolant" in the claims.

The workpiece W is a rectangular plate member elongated in a direction X, as planarly viewed, and is preformed into a predetermined flat plate shape. The thickness of the workpiece W in an upward-downward direction (direction Z) is t (see FIG. 5), the length of the workpiece W in the direction X is L1 (see FIG. 4), and the length of the workpiece W in a direction Y is L2 (see FIG. 5).

The workpiece W is made of a steel plate such as an Al-plated steel plate, a Zn-plated steel plate, a high-strength steel plate, or ordinary steel. The workpiece W is heated to a temperature higher than a martensite transformation temperature (a lowest temperature at which martensitic transformation can occur) in advance by high-frequency heating, induction heating, electrical heating, heating in a furnace, or the like so as to be conveyed in an austenitized state to the mold apparatus 100.

Figure 2:
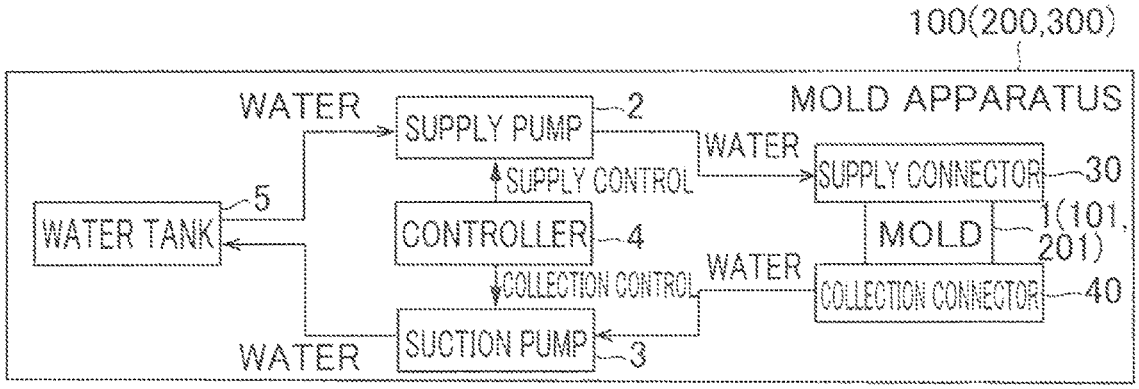
[FIG. 2] A block diagram of the mold apparatus according to the first embodiment of the present invention.

As shown in FIG. 2, the mold apparatus 100 includes a mold 1, a supply pump 2, a suction pump 3, a controller 4, and a water tank 5. The supply pump 2 has a function of supplying water from the water tank 5 to the mold 1. The suction pump 3 has a function of generating a suction force due to a negative pressure to collect the water and (or) air from the mold 1 and return the water to the water tank 5. The controller 4 controls the supply pump 2 and the suction pump 3 to supply the water to the mold 1 and collect the water from the mold 1. The supply pump 2 is an example of a "pump" in the claims.

As shown in FIG. 1, the mold 1 includes a fixed lower mold 10 and an upper mold 20 movable in the upward-downward direction (direction Z). In the mold 1, the upper mold 20 is moved downward (in a direction Z2) toward the lower mold 10 in a state where the workpiece W is placed on the lower mold 10 such that the workpiece W is sandwiched between the lower mold 10 and the upper mold 20. A plurality of supply connectors 30 connected to the supply pump 2 via supply tubes 6 and a plurality of collection connectors 40 connected to the suction pump 3 via suction tubes 7 are connected to the lower mold 10 and the upper mold 20.

Figure 3:
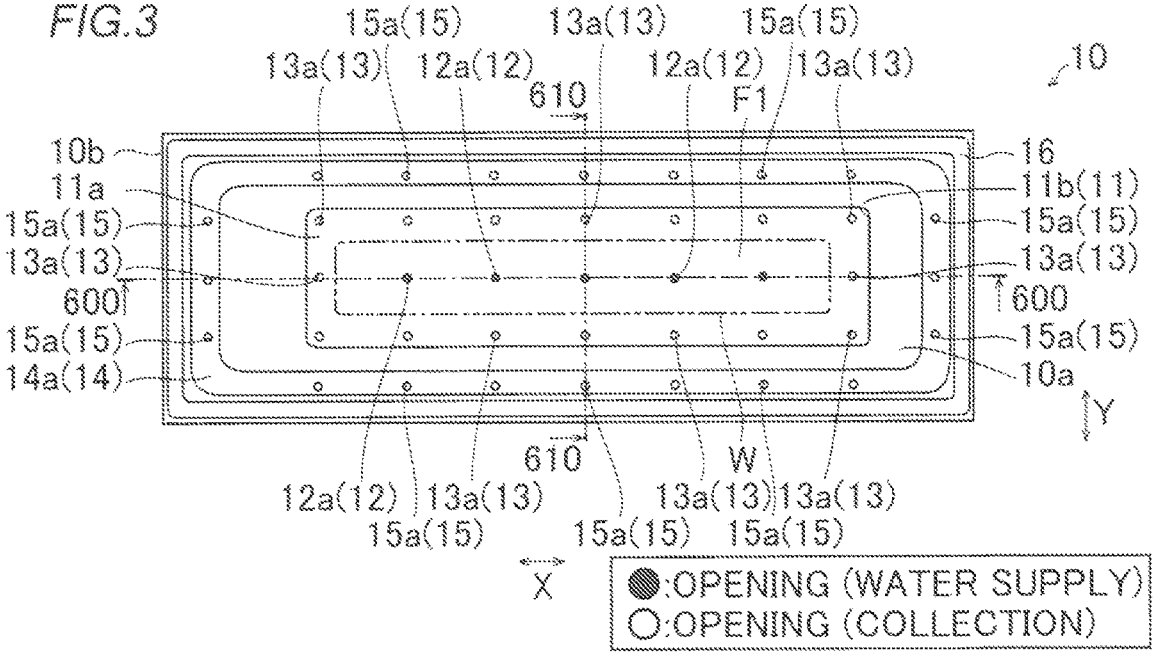
[FIG. 3] A plan view of a lower mold of the mold according to the first embodiment of the present invention.
Figure 4:
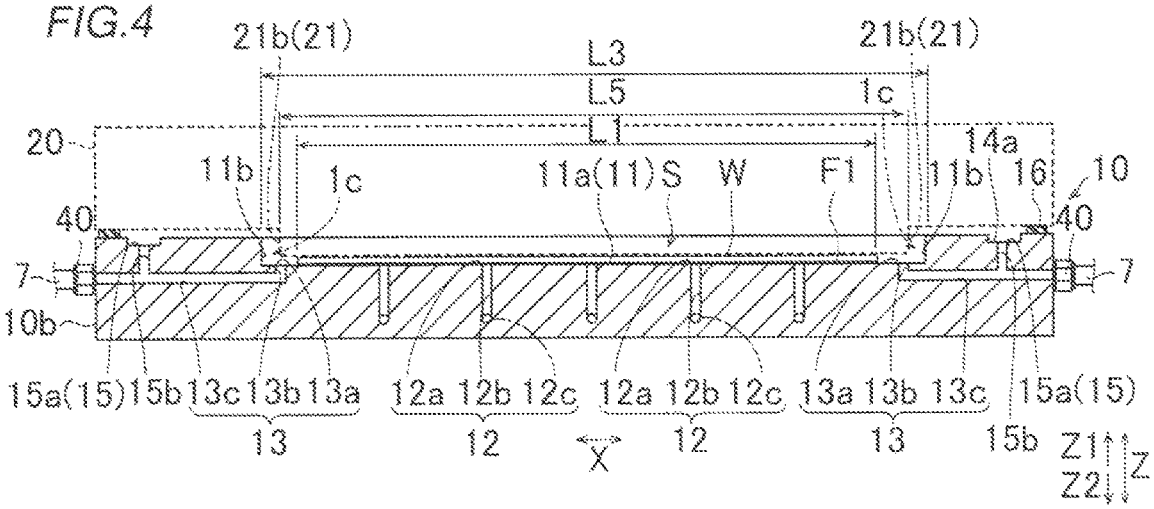
[FIG. 4] A sectional view taken along the line 600-600 in FIG. 3.
Figure 5:
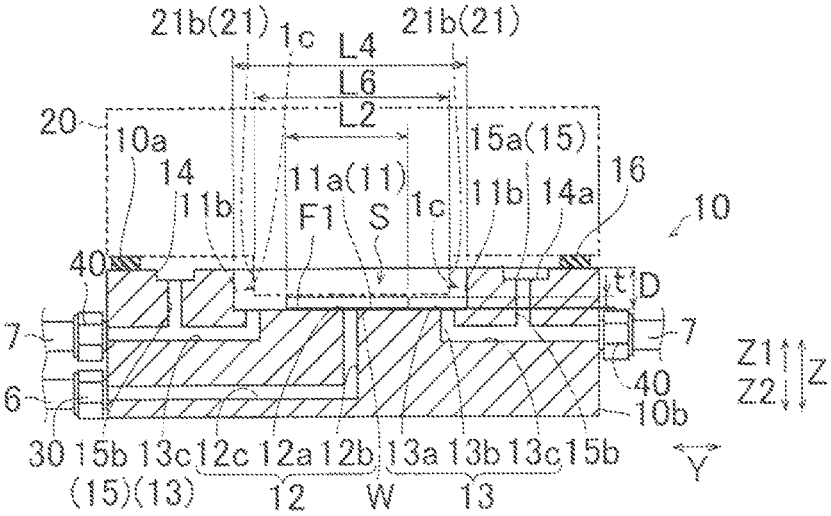
[FIG. 5] A sectional view taken along the line 610-610 in FIG. 3.

According to the first embodiment, as shown in FIGS. 3 to 5, a portion of the lower mold 10 that faces the upper mold 20 includes a recess 11 recessed downward from the upper surface (a surface located closest to the Z1 side) 10*a* of the lower mold 10. The recess 11 is formed into a rectangular shape, as planarly viewed from above (Z1 side). As shown in FIG. 5, a length (the depth D of the recess 11) in the upward-downward direction from the upper surface 10*a* to the bottom surface 11*a* of the recess 11 is larger than the thickness t of the workpiece W in the upward-downward direction. As shown in FIG. 4, the length L3 of the recess 11 in the direction X is larger than the length L1 of the workpiece W in the direction X, and as shown in FIG. 5, the length L4 of the recess 11 in the direction Y is larger than the length L2 of the workpiece W in the direction Y. Consequently, as shown in FIGS. 1 and 3, the entirety of the workpiece W can be placed in an inner space S of the recess 11.

As shown in FIGS. 3 to 5, the lower mold 10 includes a plurality of water supply passages 12 through which water for cooling the workpiece W is supplied to the inner space S of the recess 11 and a plurality of lower mold collection passages 13 through which the water in the inner space S of the recess 11 is collected.

As shown in FIGS. 4 and 5, the plurality of water supply passages 12 include openings 12*a* provided in the bottom surface 11*a* of the recess 11, first supply passages 12*b* that respectively extend downward from a plurality of openings 12*a*, and second supply passages 12*c* connected to the first supply passages 12*b* and that extend in a horizontal direction (a direction along an X-Y plane) to the outer surface 10*b* of the lower mold 10. Similarly, the plurality of lower mold collection passages 13 include openings 13*a* provided in the bottom surface 11*a* of the recess 11, first lower mold collection passages 13*b* that respectively extend downward from a plurality of openings 13*a*, and second lower mold collection passages 13*c* connected to the first lower mold collection passages 13*b* and that extend in the horizontal direction to the outer surface 10*b* of the lower mold 10.

As shown in FIG. 3, the plurality of (five) openings 12*a* (portions shown by black circles in FIGS. 1 and 3) of the water supply passages 12 are dispersedly provided in a region (molding surface F1) of the bottom surface 11*a* of the recess 11 in which the workpiece W is placed. In addition, the plurality of openings 12*a* are aligned substantially at the center in the direction Y, and the plurality of (five) openings 12*a* are aligned in the direction X. On the other hand, the plurality of (sixteen) openings 13*a* (portions shown by white circles in FIGS. 1 and 3) of the lower mold collection passages 13 surround the region of the bottom surface 11*a* of the recess 11 in which the workpiece W is placed. That is, the openings 13*a* are provided outside the openings 12*a* in the bottom surface 11*a* of the recess 11. In FIGS. 1 and 3, the openings 12*a* of the water supply passages 12 are shown by black circles, and the openings 13*a* of the lower mold collection passages 13 are shown by white circles for easy understanding, but actually, the openings 12*a* and the openings 13*a* are the same circular openings. Hereinafter, the same applies to FIGS. 6, 14, 15, 17, 18, and 21.

As shown in FIG. 5, each of the second supply passages 12*c* is connected to any one of the supply connectors 30 on the outer surface 10*b* of the lower mold 10. Furthermore, each of the second lower mold collection passages 13*c* is connected to any one of the collection connectors 40 on the outer surface 10*b* of the lower mold 10. Thus, water is ejected and supplied to the inner space S of the recess 11 of the lower mold 10 through the supply tubes 6, the supply connectors 30, and the water supply passages 12. Furthermore, the water in the inner space S of the recess 11 is collected outside of the mold 1 through the lower mold collection passages 13, the collection connectors 40, and the suction tubes 7.

As shown in FIGS. 3 to 5, in the lower mold 10, a circumferential discharge groove 14 that surrounds the entire circumference of the recess 11 is provided outside the recess 11. The discharge groove 14 is recessed downward, and has a function of temporarily storing some of the water supplied to the inner space S of the recess 11. A length (the depth of the discharge groove 14) in the upward-downward direction (direction Z) from the upper surface 10*a* to the bottom surface 14*a* of the discharge groove 14 is smaller than the depth D of the recess 11.

The lower mold 10 includes a plurality of discharge groove collection passages 15 through which the water is collected from the discharge groove 14. The plurality of discharge groove collection passages 15 include openings 15*a* provided in the bottom surface 14*a* of the discharge groove 14 and first discharge groove collection passages 15*b* that respectively extend downward from a plurality of openings 15*a* and connected to the second lower mold collection passages 13*c* of the lower mold collection passages 13. Consequently, some of the water supplied to the inner space S of the recess 11 is discharged by the discharge groove 14 and the discharge groove collection passages 15.

A frame-like sealing member 16 that surrounds the entire circumference of the discharge groove 14 is disposed in the vicinity of the outer end of the lower mold 10, which is the outside of the discharge groove 14. The sealing member 16 comes into contact with the lower surface 20*a* of the upper mold 20 in a state where the lower mold 10 and the upper mold 20 restrain the workpiece W such that the water does not leak from a space between the lower mold 10 and the upper mold 20 including the inner space S of the recess 11.

Figure 6:
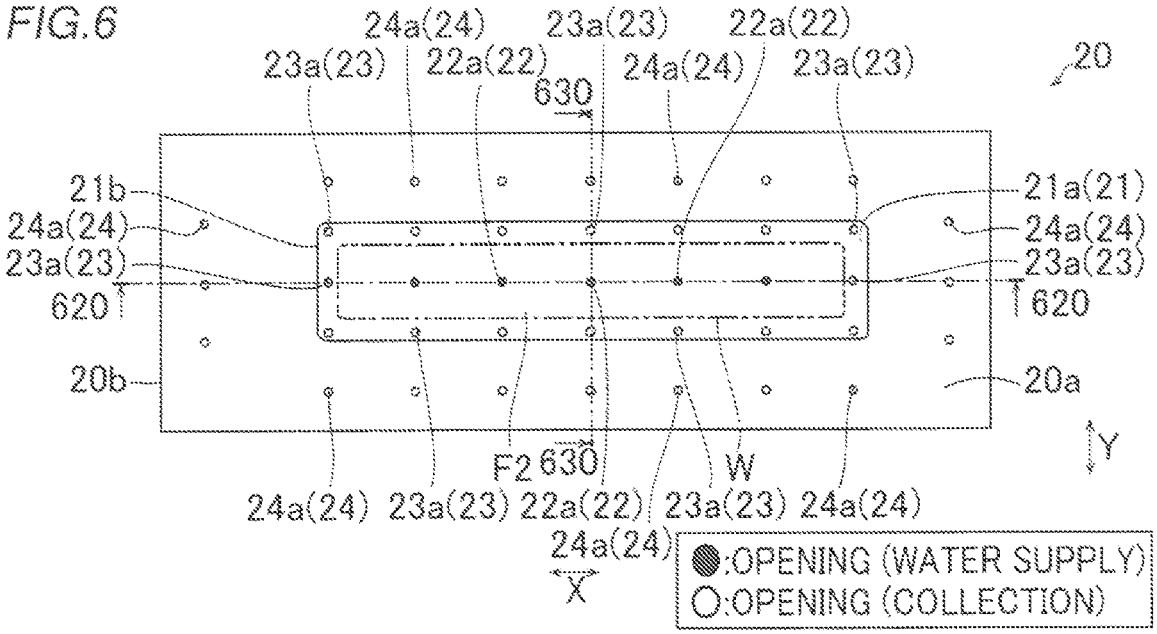
[FIG. 6] A plan view of an upper mold of the mold according to the first embodiment of the present invention.
Figure 7:
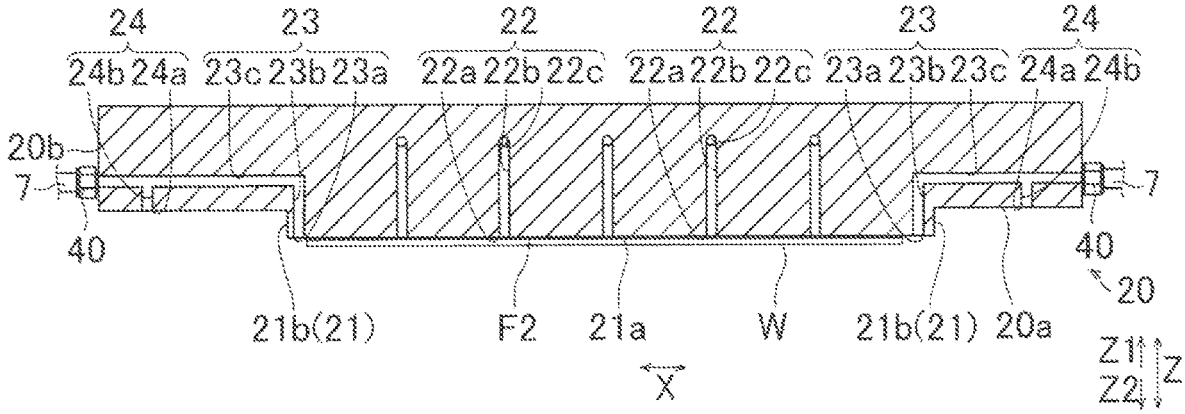
[FIG. 7] A sectional view taken along the line 620-620 in FIG. 6.
Figure 8:
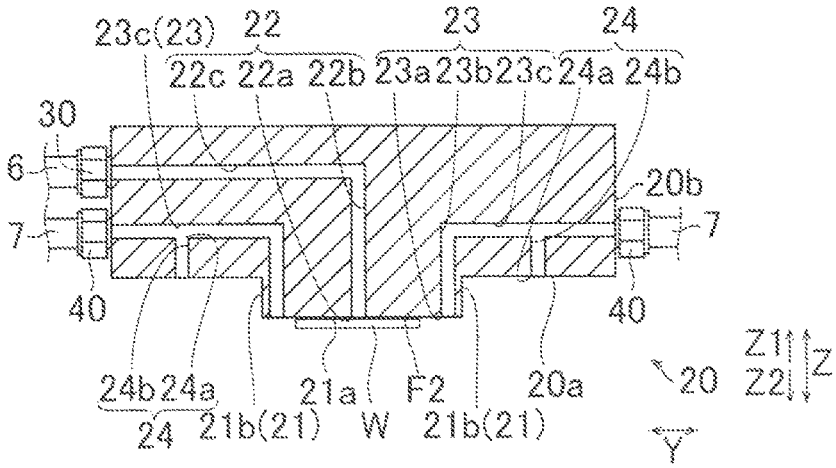
[FIG. 8] A sectional view taken along the line 630-630 in FIG. 6.

As shown in FIGS. 6 to 8, a protrusion 21 that protrudes upward from the lower surface 20*a* of the upper mold 20 is provided in a portion of the upper mold 20 that faces the lower mold 10. The protrusion 21 is formed into a rectangular shape, as planarly viewed from above. As shown in FIGS. 4 and 5, the length L5 of the protrusion 21 in the direction X is larger than the length L1 of the workpiece W in the direction X and is smaller than the length L3 of the recess 11 in the direction X. The length L6 of the protrusion 21 in the direction Y is larger than the length L2 of the workpiece W in the direction Y and is smaller than the length L4 of the recess 11 in the direction Y.

As shown in FIGS. 6 to 8, the upper mold 20 includes a plurality of water supply passages 22 through which the water for cooling the workpiece W is supplied to the inner space S of the recess 11 and a plurality of upper mold collection passages 23 through which the water and air in the inner space S of the recess 11 are collected. The plurality of water supply passages 22 include openings 22*a* provided in a protruding surface 21*a* of the protrusion 21 (the lower surface of the protrusion 21), first supply passages 22*b* that respectively extend upward from a plurality of openings 22*a* and second supply passages 22*c* connected to the first supply passages 22*b* and that extend in the horizontal direction to the outer surface 20*b* of the upper mold 20. Similarly, the plurality of upper mold collection passages 23 include openings 23*a* provided in the protruding surface 21*a* of the protrusion 21, first upper mold collection passages 23*b* that respectively extend upward from a plurality of openings 23*a*, and second upper mold collection passages 23*c* connected to the first upper mold collection passages 23*b* and that extend in the horizontal direction to the outer surface 20*b* of the upper mold 20. The upper mold collection passages 23, the first upper mold collection passages 23*b*, and the second upper mold collection passages 23*c* are examples of an "air escape passage", a "first upper mold passage", and a "second upper mold passage" in the claims, respectively.

According to the first embodiment, the upper mold collection passages 23 are provided above the workpiece W, and thus in the mold 1, the air can be discharged upward through the upper mold collection passages 23.

As shown in FIG. 6, the plurality of (five) water supply passages 22 (portions shown by black circles) are dispersedly provided in a region (molding surface F2) in which the workpiece W is placed so as to correspond to the water supply passages 12. In addition, the plurality of (sixteen) openings 23*a* (portions shown by white circles) of the upper mold collection passages 23 surround the region in which the workpiece W is placed. That is, the openings 23*a* are provided outside the openings 22*a*.

The upper mold 20 includes a plurality of upper mold collection passages 24 corresponding to the plurality of discharge groove collection passages 15. The plurality of upper mold collection passages 24 include openings 24*a* provided in the lower surface 20*a* of the upper mold 20 and first collection passages 24*b* that respectively extend upward from a plurality of openings 24*a* and connected to the second upper mold collection passages 23*c* of the upper mold collection passages 23.

The second supply passages 22*c* and the second upper mold collection passages 23*c* are respectively connected to the supply connectors 30 and the collection connectors 40 on the outer surface 20*b* of the upper mold 20. Thus, similarly to the lower mold 10, in the second mold 20, water is ejected and supplied to the inner space S of the recess 11 through the supply tubes 6, the supply connectors 30, and the water supply passages 22. Furthermore, the water and air in the inner space S of the recess 11 are collected outside of the mold 1 through the upper mold collection passages 23, the collection connectors 40, and the suction tubes 7.

According to the first embodiment, as shown in FIGS. 4 and 5, a passage 1*c* is provided between the inner surface 11*b* of the recess 11 of the lower mold 10 and the outer surface 21*b* of the protrusion 21 of the upper mold 20 in a state where the lower mold 10 and the upper mold 20 sandwich the workpiece W, and press or restrain the workpiece W. The passage 1*c* is provided circumferentially over the entire protrusion 21 so as to surround the protrusion 21. The passage 1*c* is located above the workpiece W, and thus in the mold 1, the air can be discharged upward through the passage 1*c*. The passage 1*c* is an example of an "air escape passage" in the claims.

Figure 9:
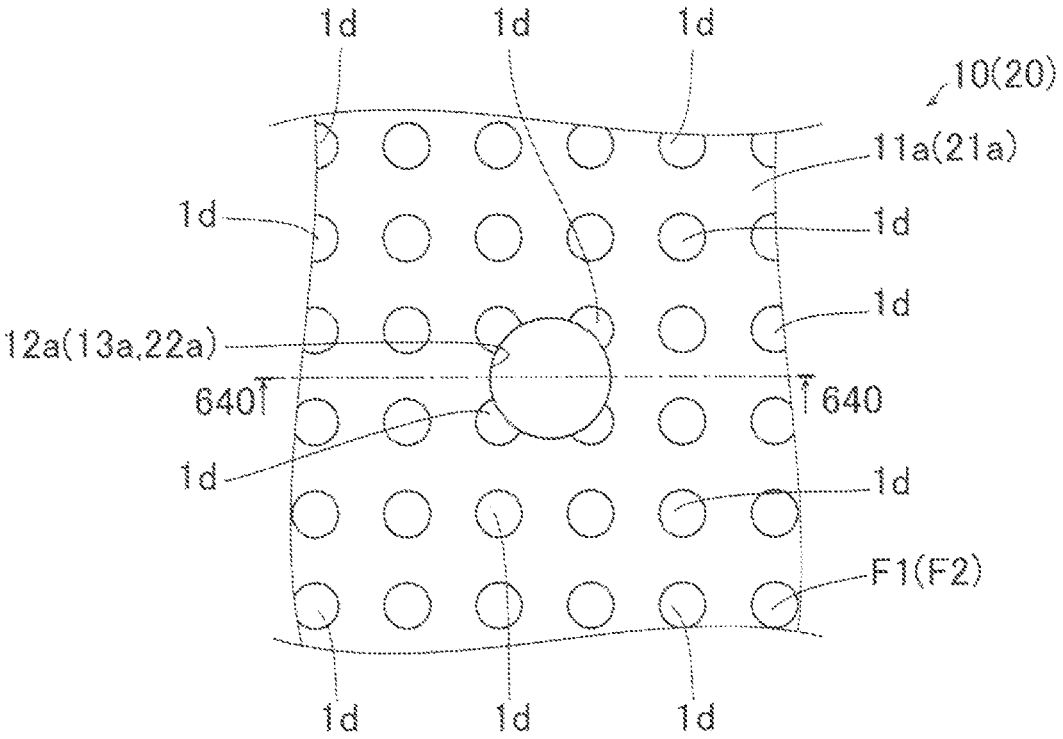
[FIG. 9] An enlarged plan view showing the states of a bottom surface and a protruding surface of the mold according to the first embodiment of the present invention.
Figure 10:
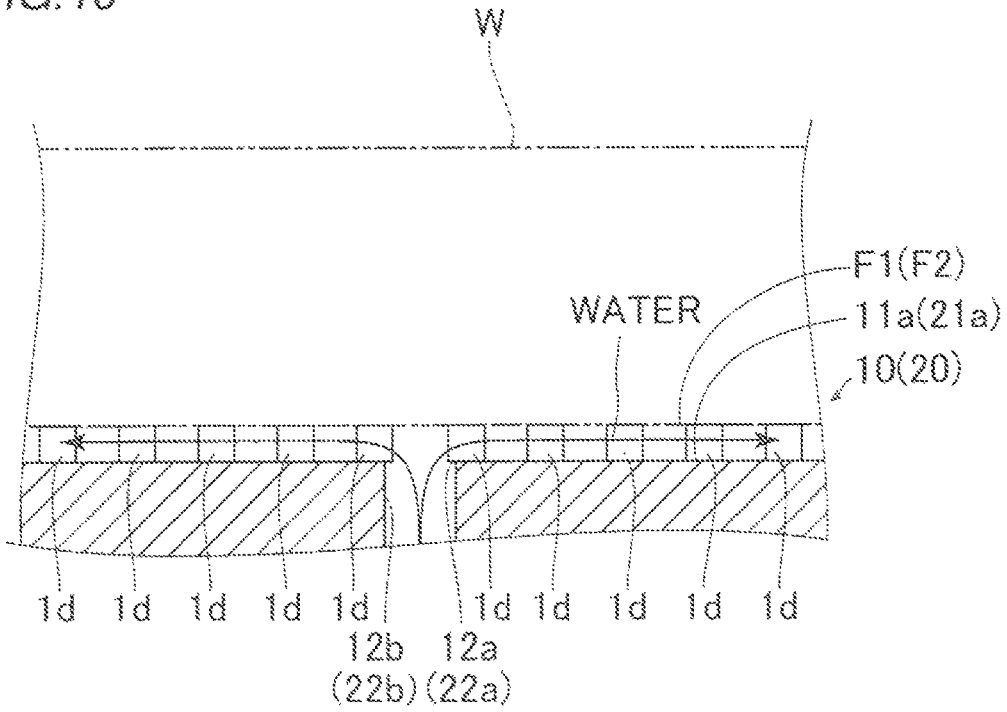
[FIG. 10] A sectional view taken along the line 640-640 in FIG. 9.

As shown in FIGS. 9 and 10, a plurality of minute protrusions 1*d* are provided at predetermined intervals on the substantially entire bottom surface 11*a* of the recess 11 and the substantially entire protruding surface 21*a* of the protrusion 21. In the mold 1, water and air can flow between the minute protrusions 1*d*. The molding surface F1 of the lower mold 10 that contacts the workpiece W is defined by protruding surfaces of the plurality of minute protrusions 1*d* provided on the bottom surface 11*a* of the recess 11. Similarly, the molding surface F2 of the upper mold 20 that contacts the workpiece W is defined by protruding surfaces of the plurality of minute protrusions 1*d* provided on the protruding surface 21*a* of the protrusion 21.

(Cooling of Workpiece Using Mold Apparatus)

A cooling method for the workpiece W using the mold apparatus 100 according to the first embodiment of the present invention is now described with reference to FIGS. 2 and 10 to 13.

Figure 11:
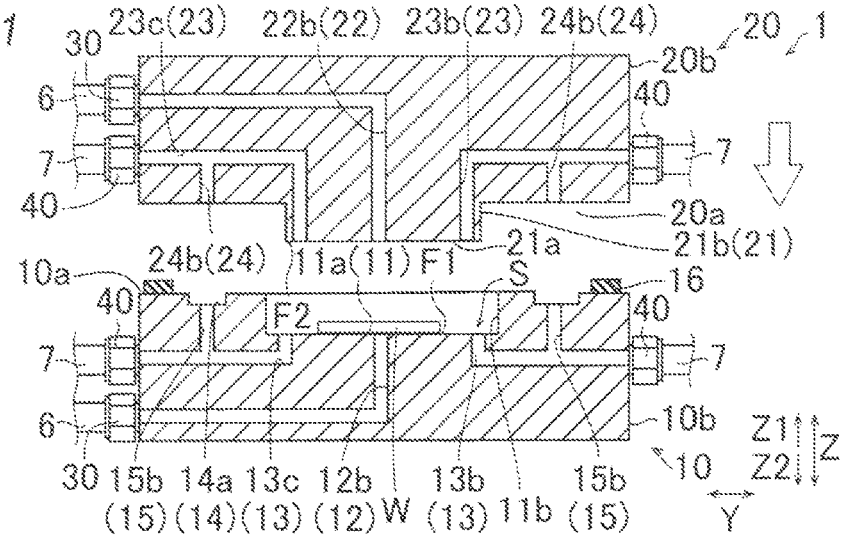
[FIG. 11] A sectional view illustrating the state of the mold apparatus according to the first embodiment of the present invention before pressing or restraining of a workpiece in a cooling method for the workpiece.

First, the workpiece W is heated to a temperature higher than the martensite transformation temperature (or bainite transformation temperature) by a heater (not shown) so as to have an austenite structure. As shown in FIG. 11, the heated workpiece W is placed on the bottom surface 11*a* of the recess 11 in the lower mold 10 of the mold apparatus 100. Thus, the heated workpiece W is placed in the inner space S of the recess 11. At this time, the plurality of minute protrusions 1*d* (see FIG. 10) are provided on the bottom surface 11*a* of the recess 11 such that cooling of the workpiece W due to contact between the workpiece W and the lower mold 10 is significantly reduced or prevented.

Figure 12:
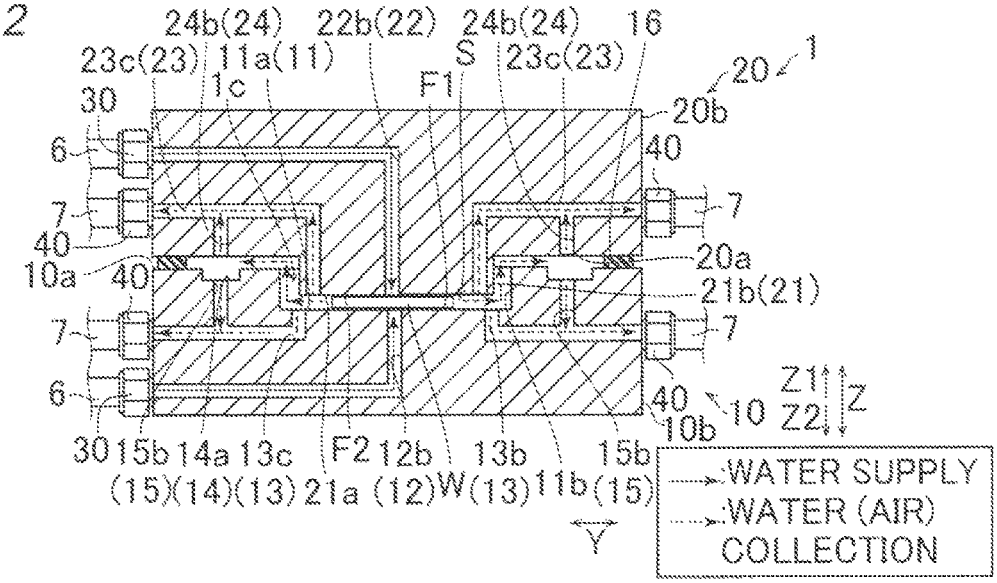
[FIG. 12] A sectional view illustrating cooling of the workpiece in a pressed or restrained state in the cooling method for the workpiece in the mold apparatus according to the first embodiment of the present invention.

Thereafter, the upper mold 20 is moved downward such that as shown in FIG. 12, the workpiece W is sandwiched between the lower mold 10 and the upper mold 20. Then, movement of the upper mold 20 is stopped such that the workpiece W is lightly pressed down by the upper mold 20, or the lower mold 10 and the upper mold 20 are held with a predetermined minute gap therebetween. Also at this time, the plurality of minute protrusions 1*d* are provided on the bottom surface 11*a* of the recess 11 and the protruding surface 21*a* of the protrusion 21 such that cooling of the workpiece W due to contact between the workpiece W and each of the lower mold 10 and the upper mold 20 is significantly reduced or prevented. At this time, the sealing member 16 seals between the lower mold 10 and the upper mold 20. Under the control of the controller 4 (see FIG. 2), water is supplied to the mold 1 by the supply pump 2.

Figure 13:
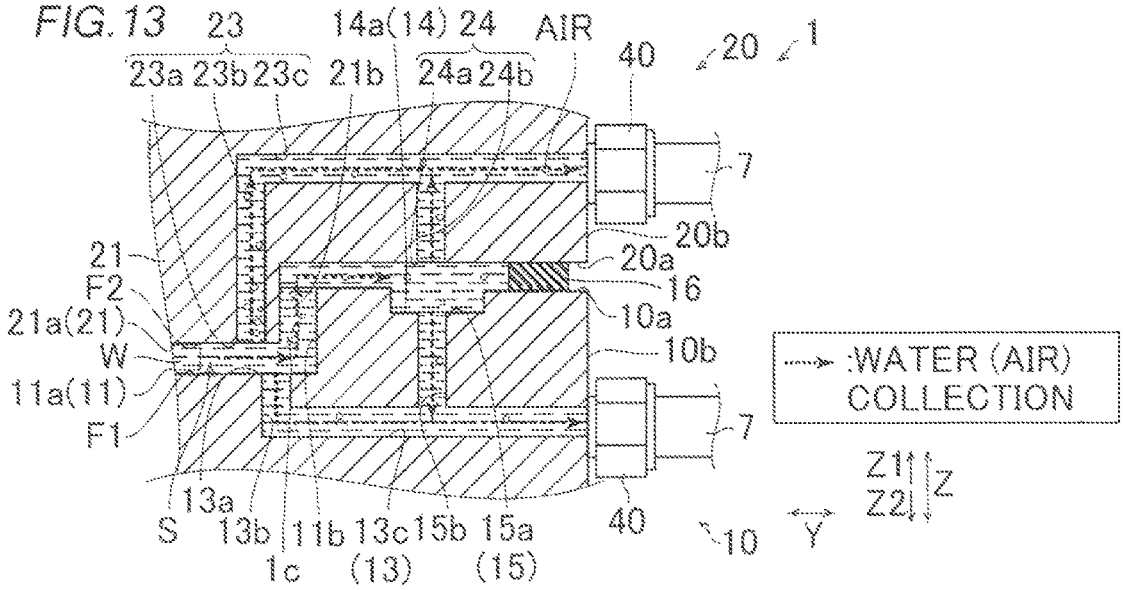
[FIG. 13] An enlarged sectional view illustrating the cooling method for the workpiece in the mold apparatus according to the first embodiment of the present invention.

Thus, the water is ejected to the workpiece W through the water supply passages 12 of the lower mold 10 and the water supply passages 22 of the upper mold 20, and is supplied to the inner space S of the recess 11. At this time, the water and air move through flow paths provided between the minute protrusions 1*d* between the workpiece W and the lower mold 10 and between the workpiece W and the upper mold 20. Consequently, as shown in FIG. 13, the air in the inner space S of the recess 11 is pushed upward by the water, the density of which is larger than that of the air to move upward in the upper mold collection passages 23 of the upper mold 20 and the passage 1*c*. Consequently, the air is discharged upward from the inner space S of the recess 11. Then, the water fills the inner space S of the recess 11, and some passes through the passage 1*c* and reaches the discharge groove 14.

At the predetermined timing, the suction pump 3 is driven by the controller 4. Thus, the air that has moved to the upper mold collection passages 23 of the upper mold 20 is collected together with the water in the suction pump 3. The air that has moved to the passage 1*c* is collected together with the water in the suction pump 3 through the discharge groove collection passages 15 of the lower mold 10 and the upper mold collection passages 24 of the upper mold 20. Depending on the drive timing of the suction pump 3, some of the air is collected together with the water in the suction pump 3 through the lower mold collection passages 13 of the lower mold 10. Then, the air is discharged from the inner space S of the recess 11 such that the inner space S of the recess 11 is filled with the water. The space between the lower mold 10 and the upper mold 20 surrounded by the sealing member 16 becomes closed such that water leakage is significantly reduced or prevented, and thus even water flow (laminar flow) can be easily created by appropriate water supply control and water collection control of the controller 4.

According to the first embodiment, retention of the air in the inner space S of the recess 11 is significantly reduced or prevented, and thus the sealing performance of the mold 1 is not required functionally. Thus, in the mold 1, the water may leak somewhat to the outside beyond the sealing member 16. Consequently, both the complicated seal structure of the mold 1 due to strict seal securement and the increased cost of providing the complicated seal structure in the mold can be significantly reduced or prevented.

Consequently, in the inner space S of the recess 11, the water is supplied to a surface of the workpiece W pressed or restrained by the mold 1 without being hindered by the air. Thus, the entirety of the workpiece W is immersed in the water so as to be rapidly cooled substantially uniformly. That is, the workpiece W is quenched. Thus, the strength (hardness) of the workpiece W is substantially uniformly improved while deformation of the workpiece W due to the rapid cooling is significantly reduced or prevented.

After cooling of the workpiece W is completed, the water in the closed space between the lower mold 10 and the upper mold 20 is discharged through the lower mold collection passages 13 and the discharge groove collection passages 15 of the lower mold 10. The workpiece W is cooled with the water, and thus the cooling time of the workpiece W is about several seconds. Finally, the upper mold 20 is moved upward, and the quenched workpiece W is taken out from the mold 1.

Effects of First Embodiment

According to the first embodiment, the following effects are achieved.

According to the first embodiment, as described above, the entirety of the workpiece W is placed in the inner space S of the recess 11 of the lower mold 10, and the water supply passages 12 and 22 through which the water is supplied to the inner space S of the recess 11 are provided in the lower mold 10 and the upper mold 20. Thus, the entirety of the workpiece W can be reliably immersed in the water, and contact of the air with the workpiece W can be significantly reduced or prevented. Furthermore, the passage 1*c* and the upper mold collection passages 23 through which the air in the inner space S of the recess 11 is discharged upward are provided in the mold 1 such that the recess 11 including the inner space S in which the entirety of the workpiece W in the pressed or restrained state is placed is filled with the water, and thus the air in the inner space S of the recess 11 can be discharged upward through the passage 1*c* and the upper mold collection passages 23. Thus, supply of the water to the surface of the workpiece W is not hindered unlike the case where the air remains in the inner space S of the recess 11. Consequently, the workpiece W can be uniformly cooled when the heated workpiece W is cooled in the pressed or restrained state. In addition, the air that has moved to the upper mold collection passages 23 of the upper mold 20 is collected together with the water in the suction pump 3, and the air that has moved to the passage 1*c* is collected together with the water in the suction pump 3 through the discharge groove collection passages 15 of the lower mold 10 and the upper mold collection passages 24 of the upper mold 20. Thus, movement (return) of the air to the inner space S can be reliably significantly reduced or prevented.

According to the first embodiment, as described above, the passage 1*c* is provided between the lower mold 10 and the upper mold 20 such that the passage 1*c* through which the air can be discharged upward in a state where the workpiece W is pressed or restrained by the lower mold 10 and the upper mold 20 can be easily provided in the mold 1.

According to the first embodiment, as described above, the upper mold collection passages 23 are provided in the protrusion 21 of the upper mold 20 such that even when the air moves upward in the inner space S of the recess 11 and remains between the upper mold 20 and the workpiece W, the air that remains in the inner space S can be discharged from the inner space S of the recess 11 through the upper mold collection passages 23 provided in the protrusion 21 of the upper mold 20.

According to the first embodiment, as described above, the passage 1*c* is provided between the inner surface 11*b* of the recess 11 of the lower mold 10 and the outer surface 21*b* of the protrusion 21 of the upper mold 20. Thus, the passage 1*c* through which the air can be discharged upward can be easily provided in the mold 1.

According to the first embodiment, as described above, the upper mold collection passages 23 includes the first upper mold collection passages 23*b* that extend upward from the molding surface F2 of the protrusion 21 and the second upper mold collection passages 23*b* connected to the first upper mold collection passages 23*b* and that extend in the horizontal direction to the outer surface 20*b* the upper mold 20. Thus, the air that remains between the upper mold 20 and the workpiece W can easily move upward through the first upper mold collection passages 23*b*.

According to the first embodiment, as described above, in the lower mold 10, the openings 13*a* of the lower mold collection passages 13 are provided outside the openings 12*a* of the water supply passages 12. In addition, in the upper mold 20, the openings 23*a* of the upper mold collection passages 23 are provided outside the openings 22*a* of the water supply passages 22. Thus, the water in the inner space S of the recess 11 can be collected through the openings 13*a* and 23*a* provided outside the openings 12*a* and 22*a* while the water is supplied into the inner space S of the recess 11 through the openings 12*a* and 22*a*. Thus, flow from the inside to the outside can be easily created, and thus even water flow (laminar flow) is easily created in the inner space S of the recess 11 such that retention of the water in the inner space S can be significantly reduced or prevented.

According to the first embodiment, as described above, the plurality of water supply passages 12 and 22 are respectively provided in the lower mold 10 and the upper mold 20 such that the water can be widely and quickly supplied to the inner space S of the recess 11. Furthermore, the water supply passages 12 and 22 are respectively provided in the lower mold 10 and the upper mold 20 such that unlike the case where the water supply passages are provided only in one of the lower mold 10 and the upper mold 20, the water can be substantially uniformly brought into contact with the upper surface and the lower surface of the workpiece W, and thus the entirety of the workpiece W can be rapidly cooled more uniformly.

According to the first embodiment, the openings 12*a* of the plurality of water supply passages 12 are dispersedly provided in the region of the recess 11 in which the workpiece W is placed in a planar view. Furthermore, the openings 22*a* of the plurality of water supply passages 22 are dispersedly provided in the region in which the workpiece W is placed in a planar view. Thus, the water can be more widely and more quickly supplied to the inner space S of the recess 11.

According to the first embodiment, as described above, the circumferential discharge groove 14 that surrounds the entire circumference of the recess 11 is provided outside the recess 11 of the lower mold 10. Thus, excessive water supplied to the inner space S of the recess 11 can be temporarily stored in the discharge groove 14, and thus water leakage from the mold 1 can be significantly reduced or prevented. Consequently, water flow in the inner space S of the recess 11 can be more easily controlled.

According to the first embodiment, as described above, the discharge groove collection passages 15 through which the water in the discharge groove 14 is collected is provided in the lower mold 10 such that continuous storing of the water in the discharge groove 14 can be significantly reduced or prevented, and thus water flow in the inner space S of the recess 11 can be reliably controlled.

According to the first embodiment, as described above, the sealing member 16 is disposed outside the recess 11 in the lower mold 10 such that the inner space S of the recess 11 can be closed, and thus water flow in the inner space S of the recess 11 can be reliably controlled while water leakage to the outside is significantly reduced or prevented.

According to the first embodiment, as described above, water supply is controlled by the controller 4 such that water flow in the recess 11 can be adjusted while the air in the inner space S of the recess 11 is discharged upward through the passage 1*c* and the upper mold collection passages 23. Thus, the workpiece W can be reliably cooled with the water.

According to the first embodiment, as described above, the water is supplied to the inner space S of the recess 11 by the supply pump 2 through the water supply passages 12 provided in the lower mold 10 and the water supply passages 22 provided in the upper mold 20, the air in the inner space S of the recess 11 is discharged upward through the passage 1*c* and the upper mold collection passages 23, and the entirety of the heated workpiece W is immersed in the water that fills the recess 11 so as to be cooled. Thus, the workpiece W can be uniformly cooled.

According to the first embodiment, as described above, the water is supplied to the inner space S of the recess 11 by the supply pump 2 such that the air in the inner space S can be discharged, and the flow rate of the water can be controlled. Thus, the workpiece W can be more effectively cooled.

Second Embodiment

The structure of a mold apparatus 200 according to a second embodiment of the present invention is now described with reference to FIGS. 2 and 14 to 16. In this second embodiment, an example in which the positions of water supply passages and collection passages of the mold apparatus 200 are different from those of the mold apparatus 100 according to the first embodiment is described. The same structures as those of the mold apparatus 100 according to the first embodiment are denoted by the same reference numerals, and description thereof is omitted.

(Structure of Mold Apparatus)

Figure 14:
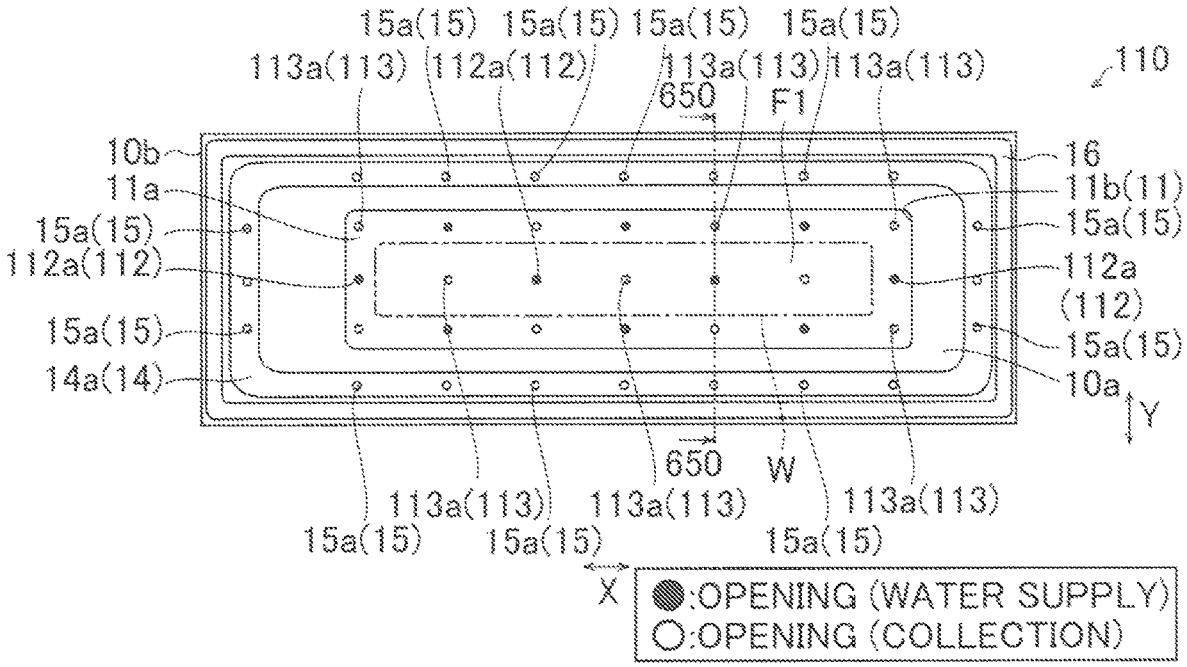
[FIG. 14] A plan view of a lower mold of a mold according to a second embodiment of the present invention.
Figure 15:
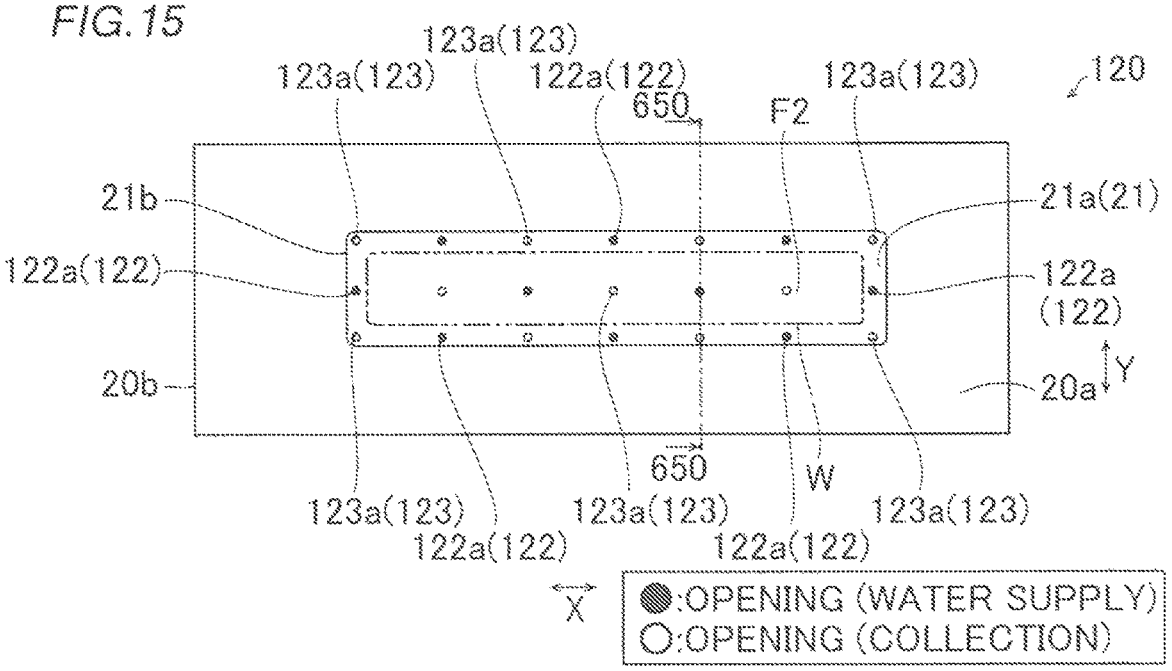
[FIG. 15] A plan view of an upper mold of the mold according to the second embodiment of the present invention.
Figure 16:
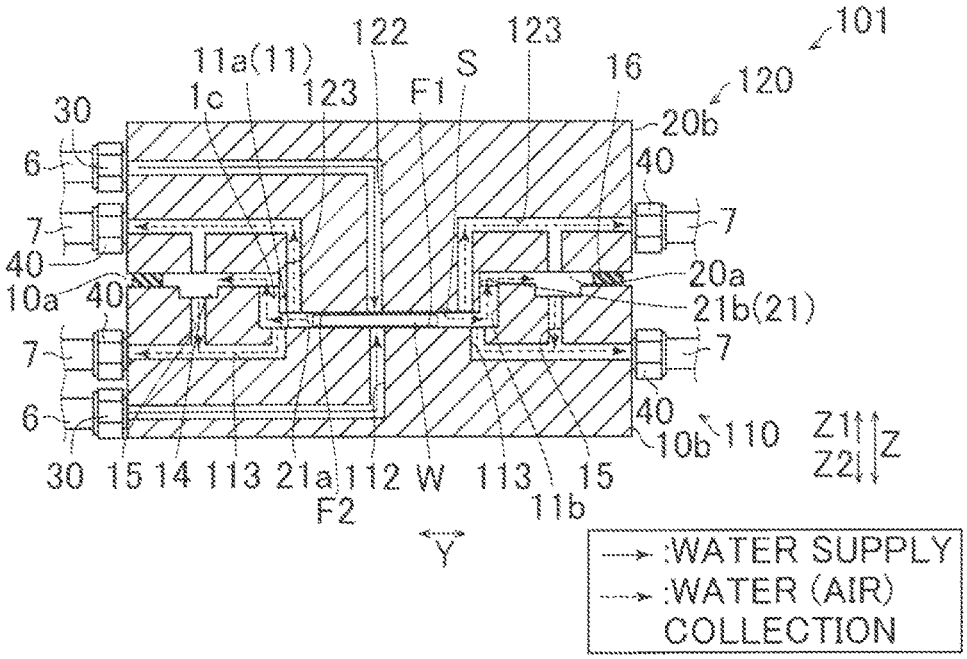
[FIG. 16] A sectional view of the mold corresponding to the line 650-650 in FIGS. 14 and 15.

As shown in FIG. 2, the mold apparatus 200 according to the second embodiment includes a mold 101 instead of the mold 1 according to the first embodiment. As shown in FIGS. 14 to 16, the mold 101 includes a fixed lower mold 110 and an upper mold 120 movable in an upward-downward direction (direction Z). A plurality of supply connectors 30 (see FIG. 16) connected to a supply pump 2 are connected to the lower mold 110 and the upper mold 120, and a plurality of collection connectors 40 (see FIG. 16) connected to a suction pump 3 are connected to the lower mold 110 and the upper mold 120.

As shown in FIGS. 14 and 16, the lower mold 110 includes a plurality of water supply passages 112 through which water for cooling a workpiece W is supplied to an inner space S of a recess 11 and a plurality of lower mold collection passages 113 through which the water in the inner space S of the recess 11 is collected. Similarly, as shown in FIGS. 15 and 16, the upper mold 120 includes a plurality of water supply passages 122 through which the water for cooling the workpiece W is supplied to the inner space S of the recess 11 and a plurality of upper mold collection passages 123 through which the water and air in the inner space S of the recess 11 are collected. The upper mold collection passages 123 are an example of an "air escape passage" in the claims.

According to the second embodiment, as shown in FIG. 14, in the lower mold 110, openings 112*a* (portions shown by black circles) of the water supply passages 112 and openings 113*a* (portions shown by white circles) of the lower mold collection passages 113 are alternately provided in the bottom surface 11*a* of the recess 11, as planarly viewed from above. Specifically, the openings 112*a* and the openings 113*a* are alternately disposed in a direction X in a region (molding surface F1) that overlaps with the workpiece W. Furthermore, the openings 112*a* and the openings 113*a* are alternately disposed in the direction X and a direction Y outside the region that overlaps with the workpiece W.

Similarly, as shown in FIG. 15, in the upper mold 120, openings 122*a* (portions shown by black circles) of the water supply passages 122 and openings 123*a* (portions shown by white circles) of the upper mold collection passages 123 are alternately provided in a protruding surface 21*a* of a protrusion 21, as planarly viewed from below. Specifically, the openings 122*a* and the openings 123*a* are alternately disposed in the direction X in a region (molding surface F2) that overlaps with the workpiece W. Furthermore, the openings 122*a* and the openings 123*a* are alternately disposed in the direction X and the direction Y outside the region that overlaps with the workpiece W. Unlike the aforementioned first embodiment, the upper mold 120 according to the second embodiment does not include upper mold collection passages corresponding to discharge groove collection passages 15 of the lower mold 110. The remaining structures of the mold apparatus 200 according to the second embodiment and a cooling method for the workpiece W using the mold apparatus 200 are similar to those according to the first embodiment, and thus description thereof is omitted.

Effects of Second Embodiment

According to the second embodiment, the following effects are achieved.

According to the second embodiment, as described above, the recess 11 of the lower mold 110 includes the inner space S in which the entirety of the workpiece W is placed. Furthermore, the water supply passages 112 and 122 through which the water is supplied to the inner space S of the recess 11 are provided in the lower mold 110 and the upper mold 120. In addition, a passage 1*c* and the upper mold collection passages 123 through which the air in the inner space S of the recess 11 is discharged upward are provided in the mold 101. Thus, similarly to the first embodiment, the workpiece W can be uniformly cooled when the heated workpiece W is cooled in a pressed or restrained state.

According to the second embodiment, as described above, in the lower mold 110, the openings 112*a* of the water supply passages 112 and the openings 113*a* of the lower mold collection passages 113 are alternately provided in the bottom surface 11*a* of the recess 11, as planarly viewed from above (in a planar view). Furthermore, in the upper mold 120, the openings 122*a* of the water supply passages 122 and the openings 123*a* of the upper mold collection passages 123 are alternately provided in the protruding surface 21*a* of the protrusion 21, as planarly viewed from below (in a planar view). Thus, before the air pushed out by the water supplied through the water supply passages 112 and 122 remains in the inner space S of the recess 11 for a long time, the air can be promptly collected through the lower mold collection passages 113 and the upper mold collection passages 123 nearby located. Thus, the workpiece W can be more uniformly cooled. Furthermore, the openings 112*a* and 122*a* through which the water is supplied and the openings 113*a* and 123*a* through which the water is collected are alternately disposed such that the flow rate of the water can be more uniform. Thus, water flow in the inner space S of the recess 11 can be more easily controlled. The remaining effects of the second embodiment are similar to those of the first embodiment, and thus description thereof is omitted.

Third Embodiment

The structure of a mold apparatus 300 according to a third embodiment of the present invention is now described with reference to FIGS. 2 and 17 to 20. In this third embodiment, the structure of a mold 201 in the case where a workpiece W1 is box-like unlike the first embodiment is described.

(Structure of Mold Apparatus)

The workpiece W1 to be quenched by the mold apparatus 300 according to the third embodiment is formed into a box shape, as shown in FIGS. 17 to 20. That is, both the cross-sections of the workpiece W1 along directions X and Y are formed into a U shape. The length L7 of an outer portion of the workpiece W1 in an upward-downward direction (direction Z) is smaller than the depth D of a recess 11. Thus, the entirety of the workpiece W1 is placed in an inner space S of the recess 11.

As shown in FIG. 2, the mold apparatus 300 according to the third embodiment includes the mold 201 instead of the mold 1 according to the first embodiment. As shown in FIGS. 17 to 20, the mold 201 includes a fixed lower mold 210 and an upper mold 220 movable in the upward-downward direction (direction Z). A plurality of supply connectors 30 (see FIG. 20) connected to a supply pump 2 are connected to the lower mold 210 and the upper mold 220, and a plurality of collection connectors 40 (see FIG. 20) connected to a suction pump 3 are connected to the lower mold 210 and the upper mold 220.

Figure 17:
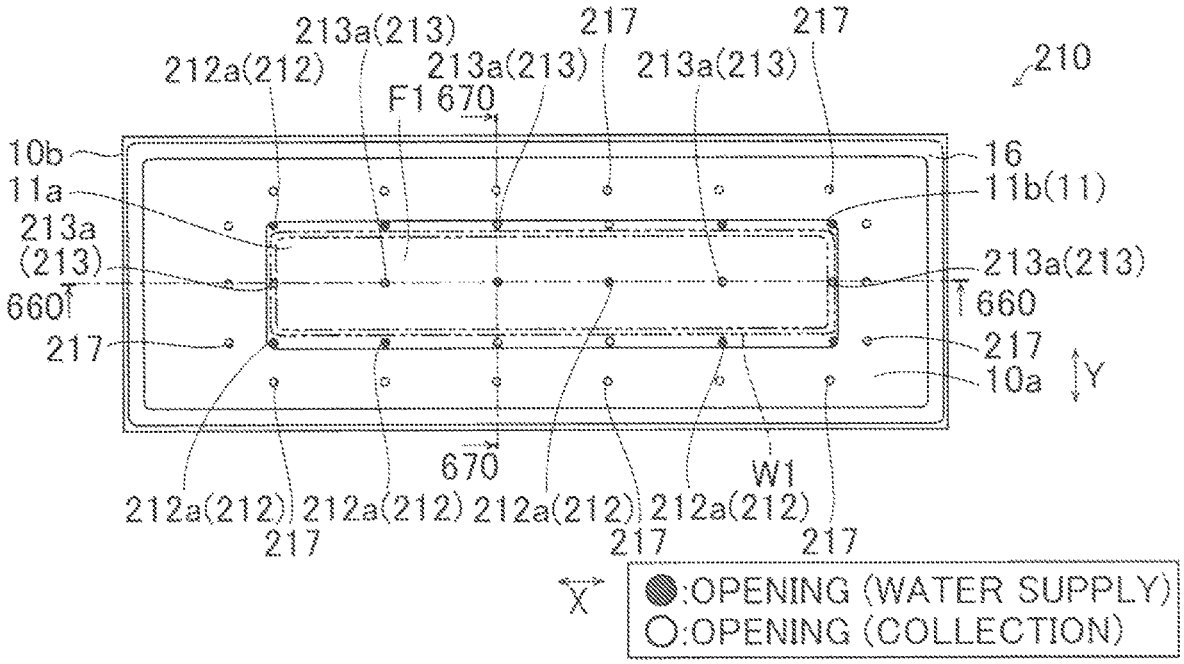
[FIG. 17] A plan view of a lower mold of a mold according to a third embodiment of the present invention.
Figure 18:
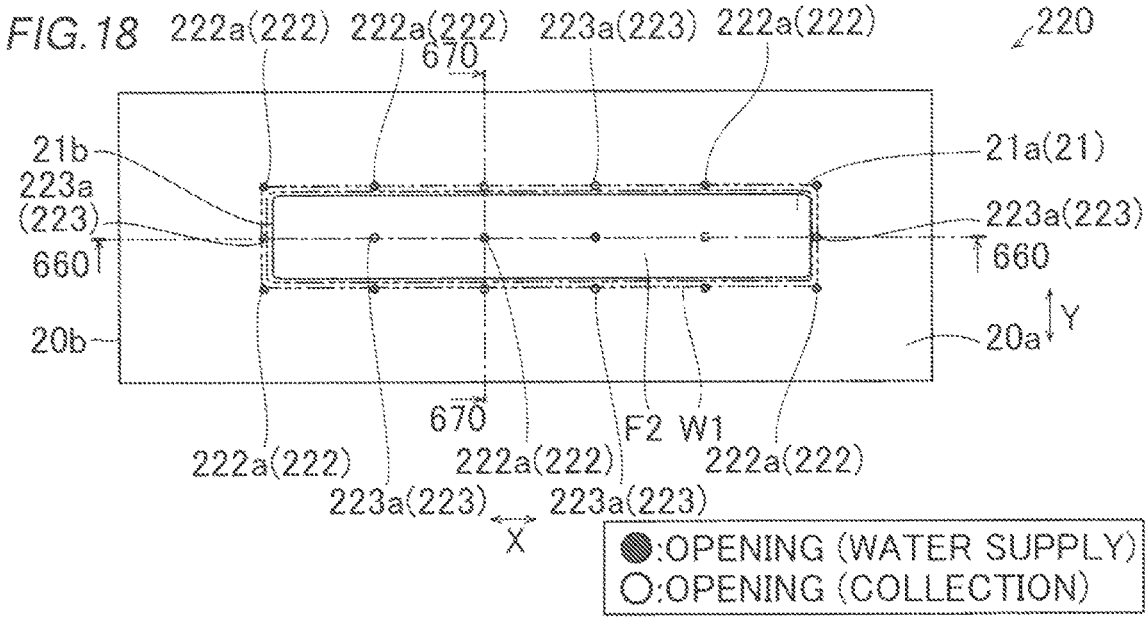
[FIG. 18] A plan view of an upper mold of the mold according to the third embodiment of the present invention.
Figure 19:
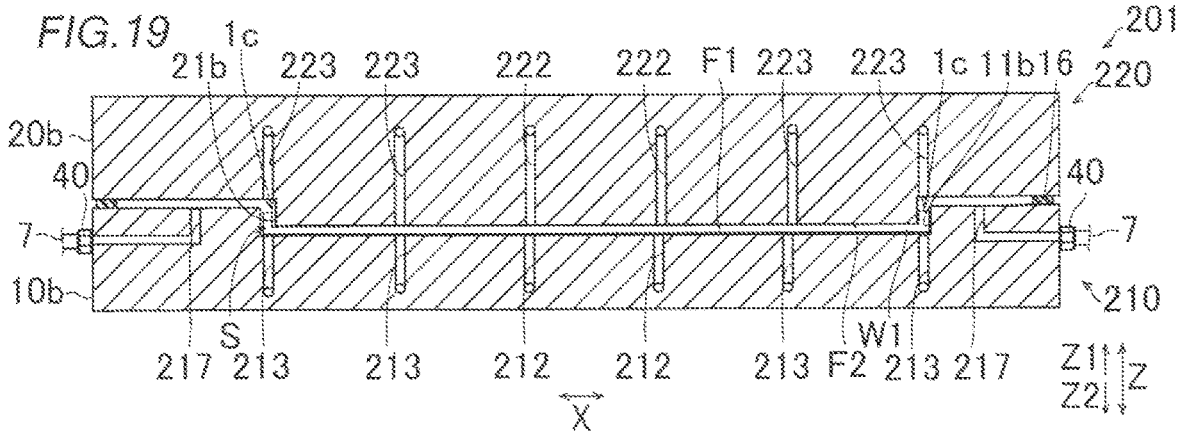
[FIG. 19] A sectional view of the mold corresponding to the line 660-660 in FIGS. 17 and 18.
Figure 20:
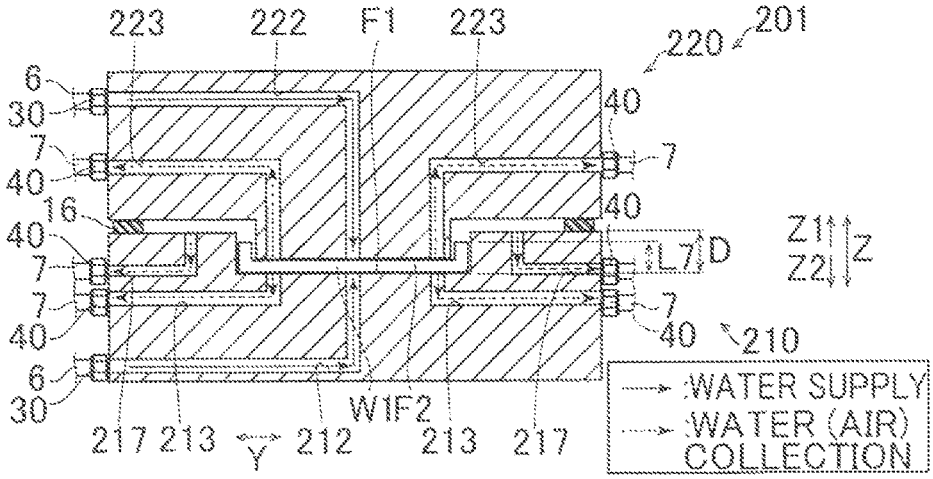
[FIG. 20] A sectional view of the mold corresponding to the line 670-670 in FIGS. 17 and 18.
Figure 21:
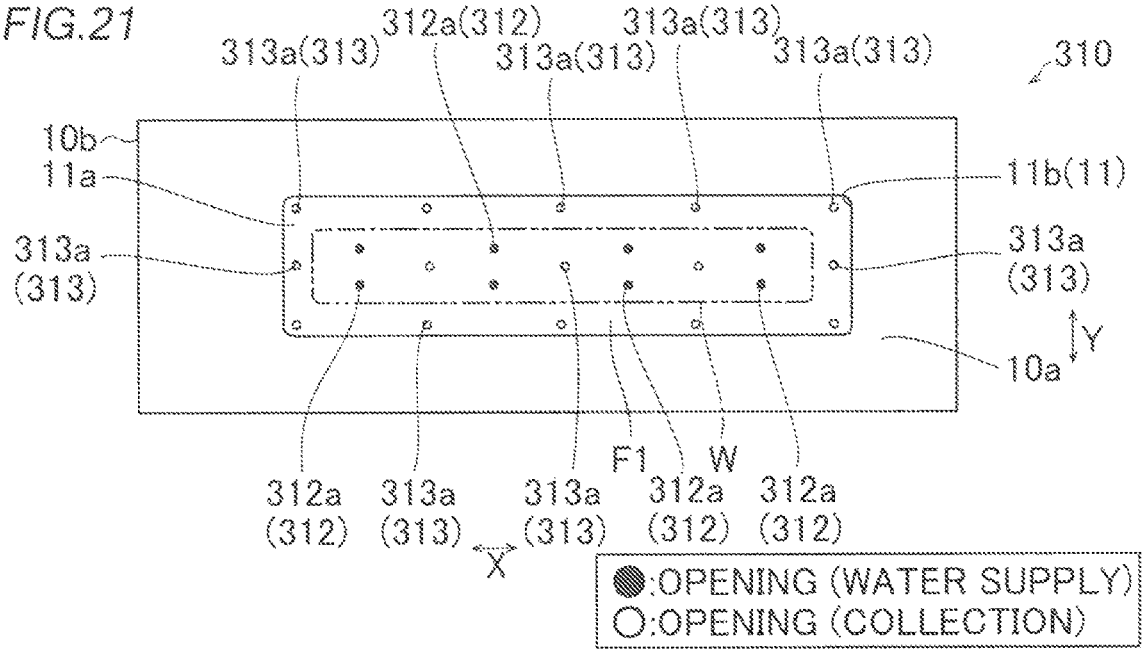
[FIG. 21] A plan view of a lower mold of a mold according to a modified example of the first embodiment of the present invention.

As shown in FIGS. 17, 19, and 20, the lower mold 210 includes a plurality of water supply passages 212 through which water for cooling the workpiece W1 is supplied to the inner space S of the recess 11 and a plurality of lower mold collection passages 213 through which the water in the inner space S of the recess 11 is collected. Similarly, as shown in FIGS. 18 to 20, the upper mold 220 includes a plurality of water supply passages 222 through which the water for cooling the workpiece W1 is supplied to the inner space S of the recess 11 and a plurality of upper mold collection passages 223 through which the water and air in the inner space S of the recess 11 are collected. The upper mold collection passages 223 are examples of an "air escape passage" in the claims.

According to the third embodiment, as shown in FIG. 17, in the lower mold 210, openings 212*a* (portions shown by black circles) of the water supply passages 212 and openings 213*a* (portions shown by white circles) of the lower mold collection passages 213 are alternately provided in the bottom surface 11*a* of the recess 11, as planarly viewed from above. Specifically, in a molding surface F1 of the bottom surface 11*a* of the recess 11, two openings 212*a* aligned in the direction X and two openings 213*a* aligned in the direction X are alternately disposed in the directions X and Y. The outermost openings 212*a* and 213*a* are provided at positions that face side surface portions of the workpiece W1 extending upward.

Similarly, as shown in FIG. 18, in the upper mold 220, openings 222*a* (portions shown by black circles) of the water supply passages 222 and openings 223*a* (portions shown by white circles) of the upper mold collection passages 223 are alternately provided in a protruding surface 21*a* of a protrusion 21, as planarly viewed from below. Specifically, in a molding surface F2 of the protruding surface 21*a* of the protrusion 21, two openings 222*a* aligned in the direction X and two openings 223*a* aligned in the direction X are alternately disposed in the direction X, and in the lower surface 20*a* in the vicinity of the periphery of the protruding surface 21*a*, two openings 222*a* aligned in the direction X and two openings 223*a* aligned in the direction X are alternately disposed in the direction X.

According to the third embodiment, a discharge groove is not provided in the lower mold 210, unlike the first embodiment. The lower mold 210 includes lower mold collection passages 217 through which water and air that have passed through a passage 1*c* and moved to the outside are collected. The remaining structures of the mold apparatus 300 according to the third embodiment and a cooling method for the workpiece W1 using the mold apparatus 300 are similar to those according to the first embodiment, and thus description thereof is omitted.

Effects of Third Embodiment

According to the third embodiment, the following effects are achieved.

According to the third embodiment, as described above, the recess 11 of the lower mold 210 includes the inner space S in which the entirety of the workpiece W1 having a box shape is placed. Furthermore, the water supply passages 212 and 222 through which the water is supplied to the inner space S of the recess 11 are provided in the lower mold 210 and the upper mold 220. In addition, the passage 1*c* and the upper mold collection passages 223 through which the air in the inner space S of the recess 11 is discharged upward are provided in the mold 201. Thus, the workpiece W1 having a box shape can be uniformly cooled when the heated workpiece W1 is cooled in a pressed or restrained state. The remaining effects of the third embodiment are similar to those according to the first embodiment and the second embodiment, and thus description thereof is omitted.

MODIFIED EXAMPLES

The embodiments disclosed this time must be considered as illustrative in all points and not restrictive. The range of the present invention is not shown by the above description of the embodiments but by the scope of claims for patent, and all modifications (modified examples) within the meaning and range equivalent to the scope of claims for patent are further included.

For example, while the example in which the discharge groove 14 and the discharge groove collection passages 15 are provided in the lower mold 10, and the sealing member 16 is disposed in the lower mold 10 has been shown in the aforementioned first embodiment, the present invention is not restricted to this. According to the present invention, the discharge groove, the discharge groove collection passages, and the sealing member may not be provided as in a lower mold 310 according to a modified example of the first embodiment in FIG. 21. Alternatively, in the mold 101 according to the aforementioned second embodiment, the discharge groove, the discharge groove collection passages, and the sealing member may not be provided, or in the mold 201 according to the aforementioned third embodiment, the sealing member may not be provided. When the sealing member is not provided in the mold, the water is discharged from the outer surface (mating surface) of the mold. In this case, in the mold apparatus, the flow rate of the liquid coolant to be supplied to the recess is preferably sufficiently increased, and the liquid coolant is preferably sufficiently overflowed from the mold. Alternatively, the sealing member may be provided in the upper mold not in the lower mold.

In the lower mold, the positions of the openings of the water supply passages and the positions of the openings of the lower mold collection passages are not particularly limited to the structures of the lower molds according to the aforementioned first to third embodiments. For example, as in the lower mold 310 according to the modified example of the first embodiment in FIG. 21, openings 312*a* of two water supply passages 312 aligned in a direction Y and openings 313*a* of three lower mold collection passages 313 aligned in the direction Y may be alternately disposed in a direction X. The water supply passages 312 and the lower mold collection passages 313 are examples of a "coolant supply passage" and a "collection passage" in the claims, respectively. Similarly, in the upper mold, the positions of the openings of the water supply passages and the positions of the openings of the upper mold collection passages are not particularly limited to the structures of the upper mold according to the aforementioned first to third embodiments. In this case, the positions of the openings of the water supply passages and the positions of the openings of the upper mold collection passages in the upper mold may or may not correspond to the positions of the openings of the water supply passages and the positions of the openings of the lower mold collection passages in the lower mold, respectively.

While the example in which the passage 1*c* and the upper mold collection passages 23 (123, 223) are provided as the "air escape passage" in the claims in the mold 1 (101, 201) has been shown in each of the aforementioned first to third embodiments, the present invention is not restricted to this. According to the present invention, for example, the collection passages through which the air in the inner space of the recess is discharged upward may not be provided in the mold, and the air in the inner space of the recess may be discharged upward only through the passage (air escape passage) provided between the inner surface of the recess of the lower mold and the outer surface of the protrusion of the upper mold. In this case, the mold is preferably small, and the shape of the mold (the shape of the workpiece) is preferably not complicated because the air can be efficiently discharged upward through the passage.

While the example in which the workpiece W formed into a flat plate shape is used has been shown in each of the aforementioned first and second embodiments, and the example in which the workpiece W1 formed into a box shape is used has been shown in the aforementioned third embodiment, the present invention is not restricted to this. According to the present invention, the shape of the workpiece is not particularly limited as long as the workpiece can be placed in the inner space of the recess of the lower mold. In order to press or restrain the workpiece, it is necessary to match the shape of the molding surface of the mold to the shape of the workpiece. However, the shape of the entire molding surface of the mold may not be matched to the shape of the workpiece. That is, it is only necessary to match the shape of a portion of the molding surface of the mold that contributes to pressing or restraining to the shape of the workpiece.

Figure 22:
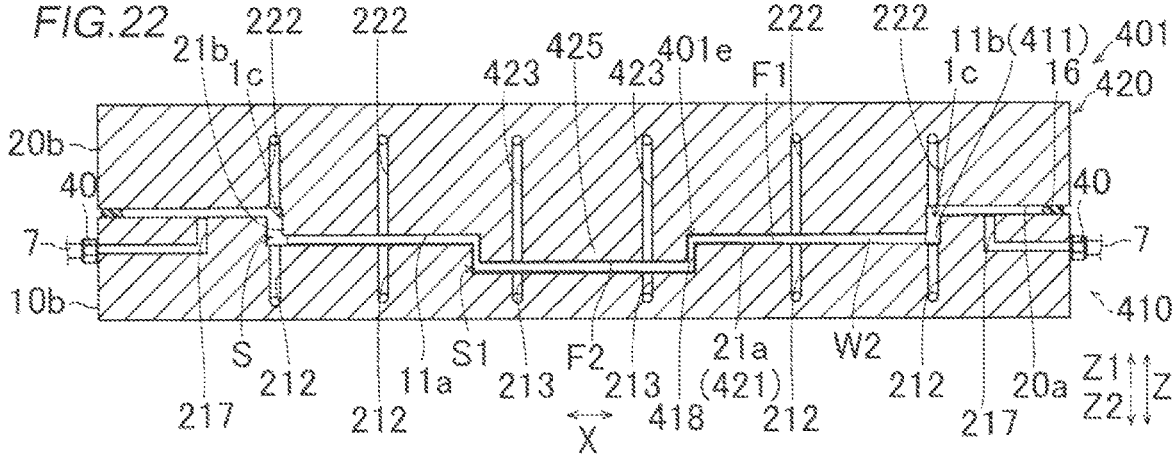
[FIG. 22] A sectional view of a mold according to a modified example of the third embodiment of the present invention.

For example, when a workpiece W2 has a stepped shape (drawing shape) in a sectional view as in a mold 401 shown in a modified example of the third embodiment shown in FIG. 22, a recess 418 recessed downward is further provided in the bottom surface 11*a* of a recess 411 of a lower mold 410 according to the sectional shape of the workpiece W2, and a protrusion 425 that protrudes downward so as to correspond to the recess 418 is provided on a protruding surface 21*a* of a protrusion 421 of an upper mold 420. Furthermore, in order to significantly reduce or prevent retention of air in the recess 418 in which air is likely to remain, upper mold collection passages 423 including openings located in the lower surface (protruding surface) of the protrusion 425 are provided in the upper mold 420. Thus, a passage 401*e* through which air in an inner space S1 of the recess 418 escapes is provided between the inner surface of the recess 418 and the outer surface of the protrusion 425. Consequently, the air in the inner space S1 of the recess 418 is discharged upward through passages 401*e* and 1*c* in addition to the upper mold collection passages 423. The passage 401*e* and the upper mold collection passages 423 are examples of an "air escape passage" in the claims.

While the example in which the sealing member 16 is disposed in the vicinity of the outer end of the lower mold 10 (110, 210) has been shown in each of the aforementioned first to third embodiments, the present invention is not restricted to this. According to the present invention, the sealing member may not be disposed in the vicinity of the outer end of the lower mold but may be disposed on the outside of the recess and the inside of the lower mold in the vicinity of the recess.

While the example in which the water supply passages (112, 212) and 22 (122, 222) are provided in the region of the recess 11 in which the workpiece W (W1) is placed has been shown in each of the aforementioned first to third embodiments, the present invention is not restricted to this. According to the present invention, as long as the coolant can be supplied to the inner space of the recess, the coolant supply passages may be provided outside the region of the recess in which the workpiece is placed.

While the example in which the plurality of water supply passages and collection passages are provided in both the lower mold and the upper mold has been shown in each of the aforementioned first to third embodiments, the present invention is not restricted to this. According to the present invention, the water supply passages and the collection passages may be provided in only one of the lower mold and the upper mold. Furthermore, the number of water supply passages, the number of collection passages, the positions of the water supply passages, and the positions of the collection passages are not particularly limited. Incidentally, the number of water supply passages, the number of collection passages, the size (hole diameter) of the water supply passages, and the size (hole diameter) of the collection passages are preferably appropriately adjusted according to the shape and size of the workpiece. In this case, the number of water supply passages, the number of collection passages, the size of the water supply passages, and the size of the collection passages are preferably adjusted such that the flow rate of the liquid coolant to be collected becomes smaller than the flow rate of the liquid coolant to be supplied.

While the example in which water is used as the "liquid coolant" in the claims has been shown in each of the aforementioned first to third embodiments, the present invention is not restricted to this. According to the present invention, in addition to water, one or a combination of polyhydric alcohols, aqueous solutions of polyhydric alcohols, polyglycol, mineral oil, synthetic ester, silicone oil, fluorine oil, grease, water emulsion, etc. may be used as the liquid coolant. It should be noted that the present invention is particularly suitable for a mold apparatus using a liquid coolant having a low temperature and a high cooling performance.

While the example in which the mold according to the present invention is provided in the so-called press quench apparatus as the mold apparatus 100 (200, 300) has been shown in each of the aforementioned first to third embodiments, the present invention is not restricted to this. According to the present invention, the mold according to the present invention may be used for a mold apparatus other than the press quench apparatus. For example, the mold according to the present invention may be used for a so-called pot press (hot press) apparatus in which a heated workpiece is press-molded into a predetermined shape, and the workpiece is cooled in a pressed state with a liquid coolant.

While the example in which the workpiece W (W1) is made of a steel plate such as an Al-plated steel plate, a Zn-plated steel plate, a high-strength steel plate, or ordinary steel has been shown in each of the aforementioned first to third embodiments, the present invention is not restricted to this. According to the present invention, a material for the workpiece is not particularly limited.

While the example in which the mold apparatus 100 (200, 300) includes the suction pump 3 has been shown in each of the aforementioned first to third embodiments, the present invention is not restricted to this. According to the present invention, the air may be discharged upward through the air escape passage at atmospheric pressure without providing the suction pump in the mold apparatus. In this case, in order to reliably discharge the air upward through the air escape passage, the air escape passage is preferably provided above a position in the recess at which the air is likely to remain when the shape of the mold is complicated, for example.

Figure 23:
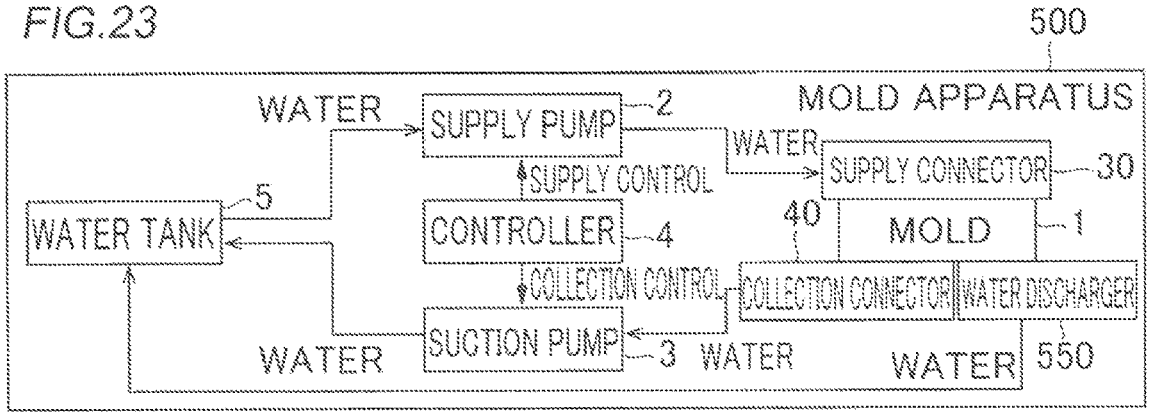
[FIG. 23] A block diagram of a mold apparatus according to a modified example of the present invention.

As in a mold apparatus 500 according to a modified example shown in FIG. 23, a water discharger 550 in which suction is not performed may be connected to a lower mold 10 separately from collection connectors 40. A portion of lower mold collection passages and discharge groove collection passages are preferably connected to the water discharger 550. Furthermore, the water discharger 550 may be used to discharge water in an inner space of a mold 1 after cooling of a workpiece is completed by the mold apparatus 500.

While the example in which the plurality of minute protrusions 1*d* are provided at the predetermined intervals on the substantially entire bottom surface 11*a* of the recess 11 and the substantially entire protruding surface 21*a* of the protrusion 21 that contact the workpiece W (W1) such that the water and air move through the flow paths provided between the minute protrusions 1*d* has been shown in each of the aforementioned first to third embodiments, the present invention is not restricted to this. For example, a plurality of grooves through which water and air can move may be provided in a portion of the mold that the workpiece W contacts.

While the example in which after the heated workpiece W is placed in the inner space S of the recess 11 and is sandwiched between the lower mold 10 and the upper mold 20, the water is supplied to the inner space S of the recess 11, the air is discharged upward from the inner space S of the recess 11, and the entirety of the workpiece W is immersed in the water so as to be cooled has been shown in each of the aforementioned first to third embodiments, the present invention is not restricted to this. According to the present invention, for example, after the water is supplied in advance to the inner space of the recess and the air is discharged upward from the inner space of the recess, the heated workpiece may be placed (immersed) in the flooded inner space of the recess, and the workpiece may be sandwiched between the lower mold and the upper mold and be cooled. In this case, the workpiece may be sandwiched between the lower mold and the upper mold after the workpiece is placed (immersed) in advance in the inner space of the recess. Alternatively, the upper mold and the workpiece may be moved together such that the workpiece is placed (immersed) in the inner space of the recess substantially at the same time as sandwiching the workpiece between the lower mold and the upper mold.

In each of the aforementioned first to third embodiments, a lifter that lifts the workpiece upward may be added to the lower mold in order to minimize contact between the workpiece and the mold. The upper mold is moved downward such that the lifter is housed in the lower mold. Thus, contact of the workpiece with the lower mold (mold) is significantly reduced or prevented except for a state where the workpiece is pressed or restrained by the mold.

DESCRIPTION OF REFERENCE NUMERALS

1, 101, 201, 401: mold
1*c*, 401*e*: passage (air escape passage)
2: supply pump (pump)
4: controller
10, 110, 210, 310, 410: lower mold
11, 411, 418: recess

12, 22, 112, 122, 212, 222, 312: water supply passage (coolant supply passage)
13, 113, 213, 313: lower mold collection passage (collection passage)
14: discharge groove
15: discharge groove collection passage
20, 120, 220, 420: upper mold
21, 425: protrusion
23, 123, 223, 423: upper mold collection passage (air escape passage)
23*b*: first upper mold collection passage (first upper mold passage)
23*c*: second upper mold collection passage (second upper mold passage)
100, 200, 300, 500: mold apparatus
F1: molding surface (of the lower mold)
F2: molding surface (of the upper mold)
S, S1: inner space
W, W1, W2: workpiece

The invention claimed is:

1. A cooling method for a workpiece, comprising:

a step for heating the workpiece by a heater to a temperature to quench, a step for placing entirety of the workpiece in an inner space of a recess provided on a molding surface of a lower mold;

a step for pressing or restraining the workpiece by a mold including the lower mold and an upper mold having a molding surface on which a protrusion corresponding to the recess of the lower mold is provided;

a step for supplying a liquid coolant to the inner space of the recess through a coolant supply passage provided in at least one of the lower mold and the upper mold by a pump, and discharging air in the inner space of the recess upward through an air escape passage in the mold; and a step for cooling the entirety of the workpiece, which has been heated to the temperature to quench, by the liquid coolant that supplies and fills the recess.

2. The cooling method for a workpiece according to claim 1, wherein in the step for discharging air upward, air in the inner space of the recess is discharged by the air escape passage provided in the protrusion of the upper mold.

3. The cooling method for a workpiece according to claim 1, wherein in the step for discharging air upward, air in the inner space of the recess is discharged by the air escape passage provided between an inner surface of the recess of the lower mold and an outer surface of the protrusion of the upper mold.

4. The cooling method for a workpiece according to claim 2, wherein in the step for discharging air upward, air in the inner space of the recess is discharged by the air escape passage provided in the protrusion of the upper mold including a first upper mold passage that extends upward from the molding surface of the protrusion and a second upper mold passage connected to the first upper mold passage that extends in a horizontal direction to an outer surface of the upper mold.

5. The cooling method for a workpiece according to claim 1, wherein in the step for discharging air upward, liquid coolant in the inner space of the recess is collected by a collection passage provided with an opening outside an opening of the coolant supply passage in the lower mold.

6. The cooling method for a workpiece according to claim 1, wherein in the step for discharging air upward, the liquid coolant is supplied in the inner space of the recess and air in the inner space of the recess is discharged upward, by openings of a plurality of the coolant supply passages provided in the lower mold and openings of the plurality of collection passages that are alternately provided in a planar view.

7. The cooling method for a workpiece according to claim 1, wherein in the step for discharging air upward, the liquid coolant is supplied in the inner space of the recess by a plurality of the coolant supply passages that are provided in each of the lower mold and the upper mold.

8. The cooling method for a workpiece according to claim 7, wherein in the step for discharging air upward, the liquid coolant is supplied in the inner space of the recess by openings of the plurality of coolant supply passages that are dispersedly provided in a region of the recess in which the workpiece is placed in a planar view.

9. The cooling method for a workpiece according to claim 1, wherein in the step for discharging air upward, the liquid coolant is discharged by a circumferential discharge groove that surrounds an entire circumference of the recess is provided outside the recess of the lower mold.

10. The cooling method for a workpiece according to claim 9, wherein in the step for discharging air upward, the liquid coolant in the discharge groove is collected by a discharge groove collection passage provided in the lower mold.

11. The cooling method for a workpiece according to claim 1, wherein in the step for discharging air upward, the liquid coolant and air are moved to an outside through the air escape passage and collected by a lower mold collection passage.

12. The cooling method for a workpiece according to claim 1, wherein in the step for discharging air upward, water leakage from between the lower mold and the upper mold is prevented by a sealing member disposed outside the recess in the lower mold or the upper mold.

* * * * *